US010178913B2

(12) United States Patent
He et al.

(10) Patent No.: US 10,178,913 B2
(45) Date of Patent: Jan. 15, 2019

(54) CHASSIS OF SWIVEL CHAIR

(71) Applicant: ZHEJIANG UE FURNITURE CO., LTD, Zhejiang (CN)

(72) Inventors: Ji He, Zhejiang (CN); Zhengfu Ruan, Zhejiang (CN)

(73) Assignee: UE FURNITURE CO., LTD., Zhejiang (CN)

( * ) Notice: Subject to any disclaimer, the term of this patent is extended or adjusted under 35 U.S.C. 154(b) by 183 days.

(21) Appl. No.: 14/910,701

(22) PCT Filed: Sep. 24, 2014

(86) PCT No.: PCT/CN2014/087311
§ 371 (c)(1),
(2) Date: Feb. 6, 2016

(87) PCT Pub. No.: WO2015/043472
PCT Pub. Date: Apr. 2, 2015

(65) Prior Publication Data

US 2016/0192782 A1 Jul. 7, 2016

(30) Foreign Application Priority Data

Sep. 24, 2013 (CN) ..... 2013 1 0438095
Sep. 18, 2014 (CN) ..... 2014 1 0479142

(51) Int. Cl.
*A47C 7/44* (2006.01)
*A47C 3/18* (2006.01)
*A47C 1/032* (2006.01)

(52) U.S. Cl.
CPC ..... *A47C 7/44* (2013.01); *A47C 1/03255* (2013.01); *A47C 1/03272* (2013.01); *A47C 1/03294* (2013.01); *A47C 3/18* (2013.01)

(58) Field of Classification Search
CPC ... A47C 7/44; A47C 1/03255; A47C 1/03272; A47C 1/03294; A47C 3/18
See application file for complete search history.

(56) References Cited

U.S. PATENT DOCUMENTS 6,523,898 B1 * 2/2003 Ball ..... A47C 1/023 297/284.4
6,945,602 B2 * 9/2005 Fookes ..... A47C 1/03255 297/300.2
7,837,265 B2 * 11/2010 Machael ..... A47C 1/023 297/300.2

(Continued)

*Primary Examiner* — Rodney B White
*Assistant Examiner* — Tania Abraham
(74) *Attorney, Agent, or Firm* — Global IP Services; Tianhua Gu

(57) ABSTRACT

A gravity self-adapted chassis of chair has the first plug pin, second plug pin, third plug pin, forth plug pin, tilting plate, first connecting rod, and the second connecting rod of the chassis form into a four-point connecting rod mechanism so as to form the conduction of the force, the backrest is fixedly connected with the tilting plate to offer the driving force of the four-point connecting rod mechanism, the gravity applied onto the seat by the users forms into the reset force applied onto the four-point connecting rod mechanism through the third plug pin hinged with the bracket, and the driving force and the reset force of the four-point connecting rod mechanism form into the confrontation relationship.

19 Claims, 16 Drawing Sheets

(56) References Cited

U.S. PATENT DOCUMENTS

| | | | | |
|---|---|---|---|---|
| 2008/0012412 | A1* | 1/2008 | Piretti | A47C 1/03233<br>297/341 |
| 2008/0252125 | A1* | 10/2008 | Bock | A47C 1/03255<br>297/313 |
| 2012/0205952 | A1* | 8/2012 | Takeuchi | A47C 1/03<br>297/300.1 |
| 2013/0082499 | A1* | 4/2013 | Schmitz | A47C 1/03255<br>297/285 |
| 2014/0028068 | A1* | 1/2014 | Birkbeck | A47C 1/022<br>297/340 |
| 2014/0077548 | A1* | 3/2014 | Peterson | A47C 1/024<br>297/284.4 |

* cited by examiner

CHASSIS OF SWIVEL CHAIR

CROSS REFERENCE TO RELATED PATENT APPLICATION

The present application is the US national stage of PCT/CN2014/087311 filed on Sep. 24, 2014, which claims the priority of the CN 201310438095.0 filed on Sep. 24, 2013 and CN 201410479142.0 filed on Sep. 18, 2014, which applications are incorporated herein by reference.

FIELD OF THE INVENTION

The invention relates to the technical field of a swivel chair and an office chair, in particular to a chassis of a swivel chair.

BACKGROUND OF THE INVENTION

A chassis of a swivel chair, also named as a tray of a swivel chair, is an important part arranged under a seating washer of the swivel chair, and the lift of the seating washer as well as the tilt angle of a backrest is adjusted thereby.

In the prior art, the chassis of the swivel chair usually consists of many parts such as an upper tray, a lower trimming beam, a rotating shaft and a spring device, wherein after an upper turn plate is fixed with the back side of a seat of the swivel chair, the swivel chair can be properly tilted around the rotating shaft and can reset automatically, so that users feel comfortable. For example, the Chinese patent discloses a tray (patent number is: 02287885.8), mainly comprising a base plate, a movable seat, a tapered pipe and an adjusting device, wherein the movable seat is movably connected onto the base plate, and the middle of the movable seat is connected with the tapped pipe of an air pressure stick, and the movable seat is welded onto the movable seat with the tapped pipe by the tapped pipe fixing plate; the adjusting device comprises an adjusting lever, an adjusting plate, a torsion spring a and a torsion spring a fixing plate, wherein the adjusting lever is inserted into the movable seat, the adjusting plate is fixedly connected onto one end of the adjusting lever, which is inserted into the movable seat, one side of the adjusting plate is contacted with the air pressure stick, and the other side thereof is connected with the torsion spring a; a rotation stopping sheet of the adjusting plate is arranged on the other side of the adjusting plate.

The adjusting device of the tray of the swivel chair is completely adjusted by the torsion spring, while for the users with different weight, the needed force of the torsion spring should be different, so that the product is not very good in universality. Aiming at the problem, the Chinese patent with the patent number of '201020264417.6' discloses a rolling shaft-adjusted tray of a swivel chair, wherein the gravity applied onto the surface of the chair is conducted into the reset force of the backrest, so that the swivel chair can be basically used for the users with different weight without being adjusted. However, when users sit on the chair provided with the tray and backwards tilt, as a part of the human gravity is supported by the backrest and the proportion is gradually increased, the gravity applied onto the surface of the seat is gradually reduced, and the reset force conduced by the gravity to the backseat is reduced along therewith, so that the reset force of the backseat is insufficient when the tilt angle is maximum, and the reset force excessively depends on the elastic recovery of an elastic reset device, therefore, the chair in the prior is limited in the target people scope, the users with light weight are hard to tilt, or the users with heavy weight are hard to reset to get up after titling, thus the most reasonable matched reset force can not be achieved.

SUMMARY OF THE INVENTION

Aiming at overcoming the defects in the prior art, the present invention provides a chassis of a swivel chair, which can be used for the users with different weight, so that not only can the discomfort caused by the shift of a waist supporting position when the backseat of the chair titles be solved so as to improve the comfort level; but also the reasonable backseat reset force can be offered from the beginning to the end during the whole process as the ratio of the gravity applied onto the seat conducted to the backrest reset force is gradually increased when the backrest of the chair tilts so as to lead both of the users with light weight or heavy weight to be capable of easily titling and resetting to get up.

The technical solution of the present invention is realized as follows:

A chassis of a swivel chair, comprising a base connected with an air rod, a bracket used for fixing a seat and a tilting plate connected with the backrest, wherein the bracket is arranged within the base, the tilting plate is arranged within the bracket, the middle of the tilting plate is provided with a first pin shaft which is taken as the rotating fulcrum thereof, the first pin shaft penetrates through the bracket and is connected with the base, a first connecting rod and a second connecting rod are symmetrically arranged at two sides at the front part of the tilting plate, one end of the first connecting rod is hinged with the front end of the tilting plate through a fourth pin shaft, the other end of the first connecting rod is hinged with one end of the second rod through a third pin shaft, the third pin shaft is connected with the bracket, the other end of the second connecting rod is provided with a second pin shaft in a penetrating way, the second pin shaft is connected with the base after penetrating though or avoiding the bracket, track grooves which are matched with the first pin shaft and used for guiding the motion trail of the bracket are symmetrically arranged at two sides of the bracket, the first pin shaft is arranged within the track grooves in a penetrating way, and the chassis further comprises an elastic reset device which leads the bracket to be capable of resetting after the bracket is titled by the tilting plate to move.

Preferably, hollow grooves which are matched with the second pin shaft and used for avoiding the second pin shaft when the bracket moves are symmetrically arranged at two sides of the bracket, and the second pin shaft is arranged within the hollow grooves in a penetrating way. The hollow grooves are arranged at two sides of the bracket, so that the bracket can not be obstructed by the second pin shaft when moving.

Preferably, the part of the two sides of the bracket, which interferes the second pin shaft, is cut, so that the bracket avoids the second pin shaft.

Preferably, the first pin shaft is an integrated long shaft, and two ends of the first pin shaft are connected with the base after respectively penetrating through the tilting plate and the track groove in sequence. Therefore, the first pin shaft can be guaranteed to offer enough intensity, thus the tilting plate can rotate freely.

Preferably, the first pin shaft is two independent short shafts, two stands are fixedly arranged on the base correspondingly, one end of each short shaft is connected with the base after penetrating through the tilting plate and the track groove in sequence, and the other end of each shaft is inserted into the corresponding stand. After the structure is adopted, the inner part of the base is more succinct, and the first pin shaft is supported by the stands, so that the intensity requirement can be met.

Preferably, the second pin shaft is an integrated long shaft, and two ends of the second pin shaft are connected with the base after respectively penetrating through the second connecting rod and the hollow grooves in sequence. Similarly, the second pin shaft can be guaranteed to offer enough intensity, thus the second connecting rod can rotate freely.

The part of the two sides of the bracket, which interferes the second pin shaft, is cut, so that the bracket avoids the second pin shaft and a joint between the second pin shaft and the base, in the case, preferably, the second pin shaft is an integrated long shaft, and two ends of the second pin shaft are connected with the base after penetrating through the second connecting rod respectively.

Preferably, the second pin shaft is two independent small shafts, two supports are fixedly arranged on the base correspondingly, one end of each short shaft is connected with the base after penetrating through the second connecting rod and the hollow grooves in sequence, and the other end of each shaft is inserted into the corresponding support. After the structure is adopted, the inner part of the base is more succinct, and the base can avoid the elastic reset device, so that the base can not be obstructed by the elastic reset device, further more, the second pin shaft is supported by the supports, so that the intensity requirement can be met.

The part of the two sides of the bracket, which interferes the second pin shaft, is cut, so that the bracket avoids the second pin shaft and a joint between the second pin shaft and the base, in the case, preferably, the second pin shaft is two independent small shafts, two supports are fixedly arranged on the base correspondingly, one end of each small shaft is connected with the base after penetrating through the second connecting rod, and the other end of each small shaft is inserted into the corresponding support.

Preferably, the connection between the first pin shaft and the base means that: first pin holes are symmetrically arranged at two sides of the back end of the base, and the first pin shaft is inserted into the first pin holes.

Preferably, the connection between the second pin shaft and the base means that: second pin holes are symmetrically arranged at two ends of the frond end of the base, and the second pin shaft is inserted into the second pin holes.

Preferably, the connection between the third pin shaft and the base means that: the third pin shaft is inserted into the bracket. The third pin shaft can be used for driving the bracket to synchronously move.

Preferably, the base comprises a base plate connected with an air rod, two support plates are respectively arranged at the left side and the right side of the base plate along with the vertical direction, the support plates are fixedly connected with the base plate, and the first pin shaft and the second pin shaft are connected with the support plates of the base; the bracket comprises two basal plates which are in parallel with each other at intervals and arranged along with the vertical direction, the basal plates are adhered to the support plates, the upper ends of the basal plates are bent to form a supporting plate used for being connected with the seat, a connecting plate is fixedly connected between the two basal plates, and the tilting plate is arranged between the two basal plates. The bracket is packed within the base, so that the chassis is reasonable in structure and more attractive.

Preferably, the first connecting rod is arranged in a tilting way towards the direction which is near to the tilting plate from bottom to top, the second rod is arranged in a tilting way towards the direction which departs from the tilting plate from bottom to top, and when the bracket moves, the inclined angle between the second connecting rod and the plumb line is always not more than 90 degrees. When the user backwards tilts, the back of the user applies a driving force onto the backrest connected with the tilting plate, and the tilting plate rotates to lever the connecting to move, so that the inclined angle between the second connecting rod and the plumb line is gradually increased, the acute angle between the second connecting rod and the horizontal line is gradually reduced, and the component force of the rotating force applied by the bracket to the second connecting rod is increased, therefore, the moment of the reset force applied by the gravity to the tilting plate and a connecting rod mechanism is gradually increased to be against the driving force which is gradually increased along with the tilt of the backrest, and the reset force is less dependent on the elastic reset force of the elastic reset device, thus the chassis is suitable for the users with different weight.

In order to lead the bracket to be always upwards moved along with the tilt direction, preferably, the track grooves and the hollow grooves are all arranged in a tilting way towards the direction which is near to the tilting plate from bottom to top.

In order to realize the lock of the backrest at some position, preferably, the chassis is further provided with a backrest tilting plate locking mechanism, wherein the backrest tilting plate locking mechanism comprises a row of lock holes symmetrically arranged on the two sides of the tilting plate as well as two torsion springs a, two plug pins and two plug pin bases, which are symmetrically arranged at the two sides within the base; the plug pin bases are fixedly arranged on the base, the plug pins are inserted onto the plug pin bases in a sliding way and are matched with the lock holes, first spring arms of the torsion springs a are connected with the plug pins, and second spring arms of the torsion springs a are connected with a drive device used for driving the torsion springs a to rotate to and fro. Due to the locking mechanism, the backrest can be fixed at some position which makes the users feel comfortable.

Preferably, the drive device comprises a crank, a positioning base and a stirring rod, wherein the positioning base is fixedly connected with the base, the positioning base is arc and is hollow in the inner part, the upper end within the positioning base is provided with an arc lug boss which downwards extends, the lug boss is configured to divide the upper end in the positioning base into two positioning grooves, the positioning base is internally provided with a fixture block, the upper end of the fixture block is clamped within the positioning grooves, two ends of the crank are connected with the second spring arms of the two torsion springs a, the crank is connected with the fixture block through a rocker, one end of the stirring rod is fixedly connected with the fixture block after penetrating through the base, and the other end of the stirring rod exposes out of the base; the stirring rod is stirred forward and backward, so that the fixture block moves from one positioning groove into another positioning groove, and the fixture block rotates to drive the crank move, therefore, the two torsion springs a are driven to rotate, and under the action of the elasticity of the torsion springs a, the first spring arms drive the plug pins inserted into the corresponding lock holes or withdrawn out of the lock holes to realize the lock and the unlock of the plug pins. The lock and the unlock of the two plug pins are realized by one stirring rod, so that the chassis is simple and ingenious in structure and convenient to use.

Preferably, the drive device further comprises two stand columns for installing the torsion springs a, the upper end of each stand column is provided with a screw in a screwing way, the torsion springs a are arranged onto the screws in a covering way, the lower end of each stand column is fixedly connected with the base through an arc bridge, a shaft hole is formed between each arc bridge and the bottom surface of the base, and the stirring rod penetrates through one of the arc bridges to be connected with the fixture block.

Preferably, the bracket is connected with the elastic reset device, the elastic reset device is a spring, one end of the spring is connected with the bracket, and the other end of the spring is connected with the base. The reset force to the tilting plate and the bracket is offered by the spring, so that the structure is simple and effective.

Preferably, a cross bar is arranged on the bracket, two end of the cross bar are fixedly connected with the bracket, one end of the spring hooks the cross bar, and the other end of the spring hooks the base. Due to the cross bar, the spring can be conveniently hooked, and the intensity of the bracket can be further increased, so that the bracket is more stable.

Preferably, the third pin shaft is connected with the elastic reset device, the elastic reset device is a spring, on end of the spring is connected with the third pin shaft, and the other end of the spring hooks the base. The third pin shaft drives the bracket synchronously move, so that the spring is connected with the third pin shaft to be capable of offering the reset force to the bracket.

Preferably, the elastic reset device is a torsion spring b, the torsion spring b is arranged on the first pin shaft in a covering way, the tilting plate comprises two side plates which are in parallel with each other at intervals and a connecting plate which is connected with the two side plates and the backrest, the connecting plate is arranged outside the base, a baffle plate is arranged on the bottom surface of the base, one torsion arm of the torsion spring b leans against the baffle plate, and the other torsion arm of the torsion spring b leans against the connecting plate. When the tilting plate is tilted, one torsion arm of the torsion spring b is kept to be immovable, and the connecting plate extrudes the other the torsion arm of the torsion spring b to reduce the distance between the two torsion arms, so that the elastic force for resetting the tilting plate can be generated.

Preferably, the elastic reset device is a rubber spring, the rubber spring comprises a rubber layer circumferentially fixed on the first pin shaft, wherein a cylinder-shaped shell is fixedly covered outside the rubber layer, a pair of connecting lugs are fixedly arranged on the cylinder-shaped shell, the first pin shaft is fixedly connected with the base, and the connecting lugs are hinged with the tilting plate. When the tilting plate is tilted, the cylinder-shaped shell is driven to rotate at a certain rotation angle, and the first pin shaft is fixed, so that the rubber layer generates the torsion force due to the rotation of the cylinder-shaped shell, the torsion force is in direct proportion to the rotation angle of the cylinder-shaped shell, and the tilting plate can be driven to be reset due to the torsion force, so that the backrest can be adjusted freely at any angle.

Preferably, the tilting plate comprises two side plates which are in parallel with each other at intervals and a connecting plate which is connected with the two side plates and the backrest, the connecting plate is arranged outside the base, a base body is fixedly arranged on the connecting plate, and the connecting lugs are hinged with the base body. The base body is configured to be conveniently matched with the connecting lugs.

In order to obtain the enough support intensity, preferably, the fourth pin shaft is an integrated long shaft, and two ends of the fourth pin shaft are respectively connected with one end of the first connecting rod and the front end of the tilting plate.

Preferably, the fourth pin shaft is connected with the elastic reset device, the elastic reset device is a spring, one end of the spring is connected with the fourth pin shaft, and the other end of the spring hooks the base.

Preferably, the connecting position between the other end of the spring and the base is arranged within the back end of the base. That is, the connecting position between the other end of the spring and the base is the position which is far away from the first connecting rod and the second connecting rod. The configuration has the following advantages: when the tilting plate rotates, the fourth pin shaft rotates around the first pin shaft to drive the spring lengthened. During the process, the moment arm (i.e. the distance that the first pin shaft is perpendicular to the axis of the spring) of the spring relative to the first pin shaft is gradually reduced, the spring-lengthened amplitude is obviously changed to lead the pull force to be obviously increased, due to the match relationship between the pull force of the spring and the moment arm, when the spring is lengthened, the torque of the spring relative to the first pin shaft is evenly increased, the reset force conducted to the backrest is gradually increased as well, and when users backwards tilt, the support force applied by the backrest to the back of the users is even, so that the users feel more comfortable, and the uncomfortable problem caused by the too small or too large reset force during each stage when the users backwards tilt can be avoided.

Preferably, a plastic sleeve is covered on the fourth pin shaft, and one end of the spring is suspended on the plastic sleeve. Therefore, the fricative among metals can be avoided, so that the users feel very good when using the chair.

Preferably, the chassis is further provided with a backrest tilting plate locking mechanism, wherein the backrest tilting plate locking mechanism comprises a lock plate, a torsion spring a, a plug pin and a plug pin base, a row of lock holes are arranged on the lock plate, the lock plate is fixedly connected with the forth plug pin and moves synchronously with the forth plug pin under the action of the tilting plate, the plug pin base is arranged beside the lock plate and is fixedly connected with the base, the plug pin is inserted onto the plug pin base in a sliding way and is matched with the lock holes, a first spring arm of the torsion spring a is connected with the plug pin, and a second spring arm of the torsion spring a is connected with a drive device used for driving the torsion spring a to rotate back and force. The tilting plate can be locked by the locking mechanism by the means that one plug pin is matched with one lock plate, so that the chassis can be conveniently controlled.

Preferably, the chassis is further provided with a backrest tilting plate locking mechanism, wherein the backrest tilting plate locking mechanism comprises a lock plate, a torsion spring a, a plug pin and a plug pin base, a row of lock holes are arranged on the lock plate, the lock plate is connected with an extension section which is integrated with the lock plate and is arranged on the same plane therewith, two ends of the extension section are respectively connected with the first pin shaft and the forth plug pin in a covering way, the extension section is axially fixed relative to the forth plug pin, the plug pin base is arranged beside the lock plate and is fixedly connected with the base, the plug pin is inserted onto the plug pin base in a sliding way and is matched with the lock holes, a first spring arm of the torsion spring a is connected with the plug pin, and a second spring arm of the torsion spring a is connected with a drive device used for driving the torsion spring a to rotate back and force. The lock plate is provided with the extension section, so that the moment arm can be lengthened, the lock plate is enough in support intensity, and the bend or the deformation can be avoided, therefore, the service life can be prolonged.

Preferably, the drive device comprises a support base, a stirring rod and a positioning ring which is deformable after being forced, wherein the support base is fixedly arranged on the plug pin base, the positioning ring is fixedly arranged on the support base, the torsion spring a is covered on a screw, the screw is fixedly arranged on the support base, the positioning ring is internally provided with a kidney-shaped hole, an arc lug boss is arranged in the middle of the kidney-shaped hole, the poisoning ring is internally divided into two clamp grooves due to the configuration of the lug boss, one end of the stirring rod extends into the positioning ring after penetrating through the base, and the other end of the stirring rod exposes out of the base; a second spring arm of the torsion spring a is connected with the end of the stirring rod, which extends into the positioning ring, and the stirring rod is stirred, so that the end of the stirring end, which extends into the poisoning ring, moves into the other clamp groove from one clamp groove, and the torsion spring a is driven to rotate, under the elasticity action of the torsion spring a, the first spring arm pulls the plug pin to be inserted into the corresponding lock holes or withdrawn out of the lock holes, therefore, the plug pin can be locked and unlocked. After the structure is adopted, the drive device is not only simple in structure but also convenient to install.

Preferably, the lock plate is arranged in the middle of the forth plug pin or at the position which is near to the middle. Therefore, the tilting plate locking force position is transferred to the middle of the chassis, and the chassis can be controlled only by the means that one plug pin is matched with one lock plate, so that not only can the aligning accuracy of the plug position be conveniently achieved, but also the chassis is more even in whole stress.

Preferably, the plane where the lock plate is arranged is perpendicular to the axis of the forth plug pin.

Preferably, the upper end face and the lower end face of the lock plate are concaved to form grooves which are matched with the plug pin in a leaning way, and the plug pin outwards extends and is clamped within the grooves of the upper end face and the lower end face, so that the tilting plate can be locked at the initial angle and the maximum angle.

Preferably, a plastic sleeve is covered onto the forth plug pin, the intercrossed position between the plastic sleeve and the extension section is cut off to form a gap, and the extension section is properly clamped within the gap. Due to the plastic sleeve, not only can the voice caused by the direct contact between the spring and the forth plug pin be avoided, but also the lock plate and the extension plate can be locked, so that the plastic sleeve is dual purpose.

Preferably, the extension section is fixed with the forth plug pin in a welding way. Therefore, the lock plate and the extension section can not move along with the axial direction of the forth plug pin.

INDUSTRIAL APPLICABILITY AND ADVANTAGEOUS EFFECTS

By adopting the technical solutions, the present invention has the design starting point, the idea and the beneficial effect as follows:

When the users backwards tilt, in the case of the same gravity applied to the seat, the reset force moment of the chassis in the prior art is gradually reduced or invariably kept, the pressure applied onto the backrest when the users tilt is increased, and the driving force is increased, so that the reset fore is not enough to be against the driving force, and the reset force depends too much on the elastic reset of the elastic reset device, therefore, the chair in the prior is limited in the applicable people scope, the users with light weight are hard to tilt, or the users with heavy weight are hard to reset to get up.

The present invention provides a gravity self-adapted chassis of chair which is free of manual adjustment, more human-friendly and better in university, and the chair provided with the chassis can offer the corresponding matched tilting reset force to the backrest according to the weight of the users, so that the users with light weight or heavy weight can easily tilt and reset to get up.

Specifically, the first plug pin, the second plug pin, the third plug pin, the forth plug pin, the tilting plate, the first connecting rod and the second connecting rod of the chassis form into a four-point connecting rod mechanism so as to form the conduction of the force, the backrest is fixedly connected with the tilting plate to offer the driving force of the four-point connecting rod mechanism, the gravity applied onto the seat by the users forms into the reset force applied onto the four-point connecting rod mechanism through the third plug pin hinged with the bracket, and the driving force and the reset force of the four-point connecting rod mechanism form into the confrontation relationship.

When the users backwards tilt, once the inclined angle between the second connecting rod of the four-point connecting rod mechanism and the horizontal line is gradually reduced, the component force of the rotation force applied to the second connecting rod by the bracket is increased, so that the force moment of the reset force applied by the gravity to the four-point connecting rod mechanism is gradually increased to be against the driving force which is gradually increased, and the reset force depends less on the elastic reset force of the elastic reset device, therefore, the chassis of the chair is wider in applicable people scope, and the users with light weight or heavy weight can easily tilt and reset to get up.

Furthermore, when the users backwards lean, the seat backwards moves along with the rotation of the backrest as well, so that a waist support of the backrest always fit the corresponding position of the back of the users, therefore, the waist suspension as the waist support of the backrest departs from the waist of the users can be avoided, and the friction between the clothes and the chair can be avoided.

DETAILED DESCRIPTION OF THE PREFERRED EMBODIMENTS

Figure 1:
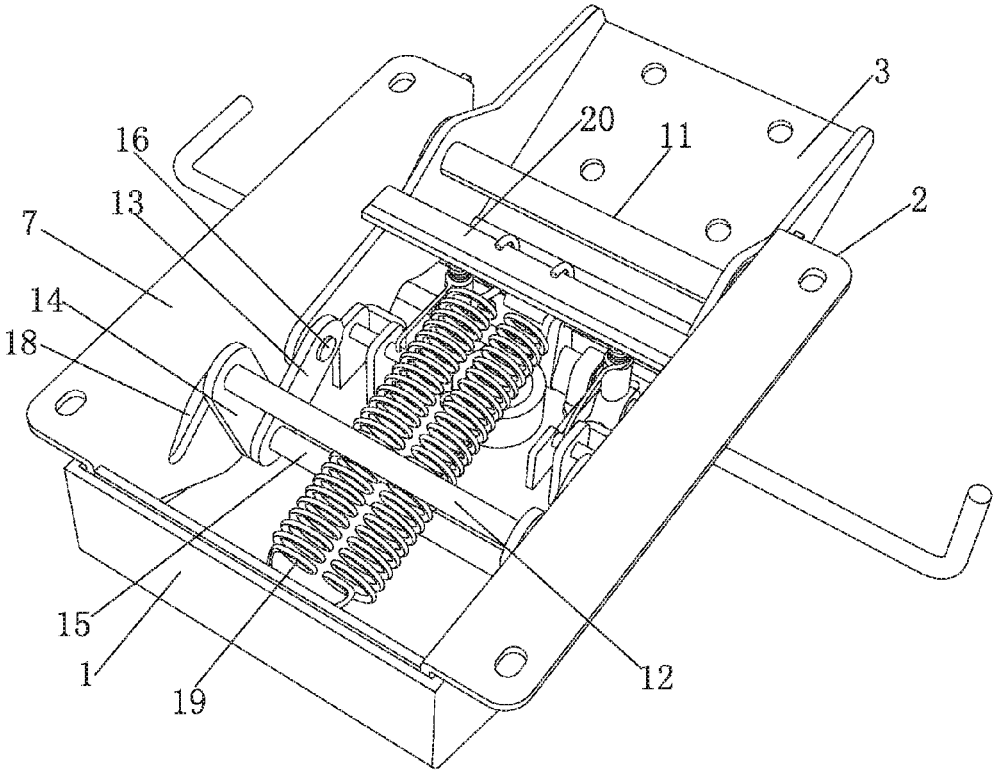
FIG. 1 is the three-dimensional structure schematic diagram of the chassis of the present invention in embodiment 1.

The specific embodiments of the present invention are as follows:

Embodiment 1: firstly, the reference position of each part of the present invention is defined, when the chassis and the swivel chair are normally installed and used, the front of the swivel chair is the front end, the back of the swivel chair, inducing the position where the backrest is arranged, is the back end, the front end of the chassis is the region which is far away from the tilting plate, and the back end of the chassis is the region which is near to the tilting plate.

A chassis of a swivel chair, as show in FIG. 1-FIG. 6, comprising a base 1 connected with an air rod, a bracket 2 for fixing the chair and a tilting plate 3 connected with the backrest, wherein the bracket 2 is arranged within the base 1, and the tilting plate 3 is arranged within the bracket 2; specifically, the base 1 comprises a base plate 4 connected with the air rod, two support plates 5 are respectively arranged at the left side and the right side of the base plate 4 along the vertical direction, the support plates 5 are fixedly connected with the base plate 4, and the base plate 4 plays a part in supporting the whole chassis, the seat and the backrest; the bracket 2 comprises two basal plates 6 which are in parallel with each other at intervals and arranged along the vertical direction, the basal plates 6 are adhered to the support plates 5, the upper ends of the basal plates 6 are bent to form a support plate 7 to be connected with the seat, connecting plates 8 are fixedly connected between the two basal plates 6, the connecting plates 8 are plural, the two basal plates 6 are fixedly connected with each other by the connecting plates 8, and the tilting plate 3 is arranged between the two basal plates 6.

Figure 2:
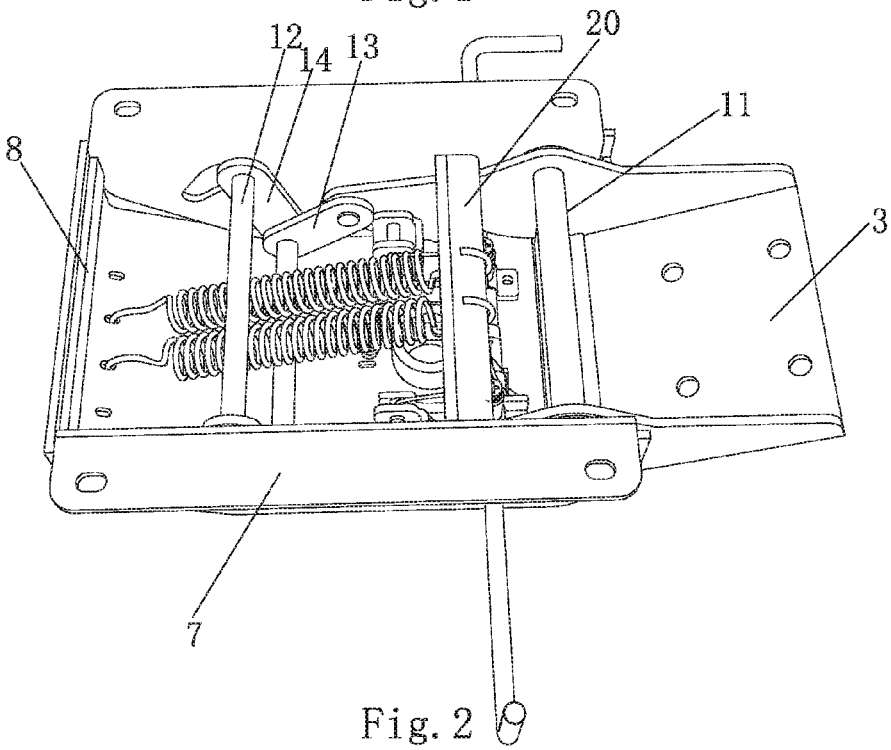
FIG. 2 is the three-dimensional structure schematic diagram of the other angle of the chassis of the present invention in embodiment 1.
Figure 3:
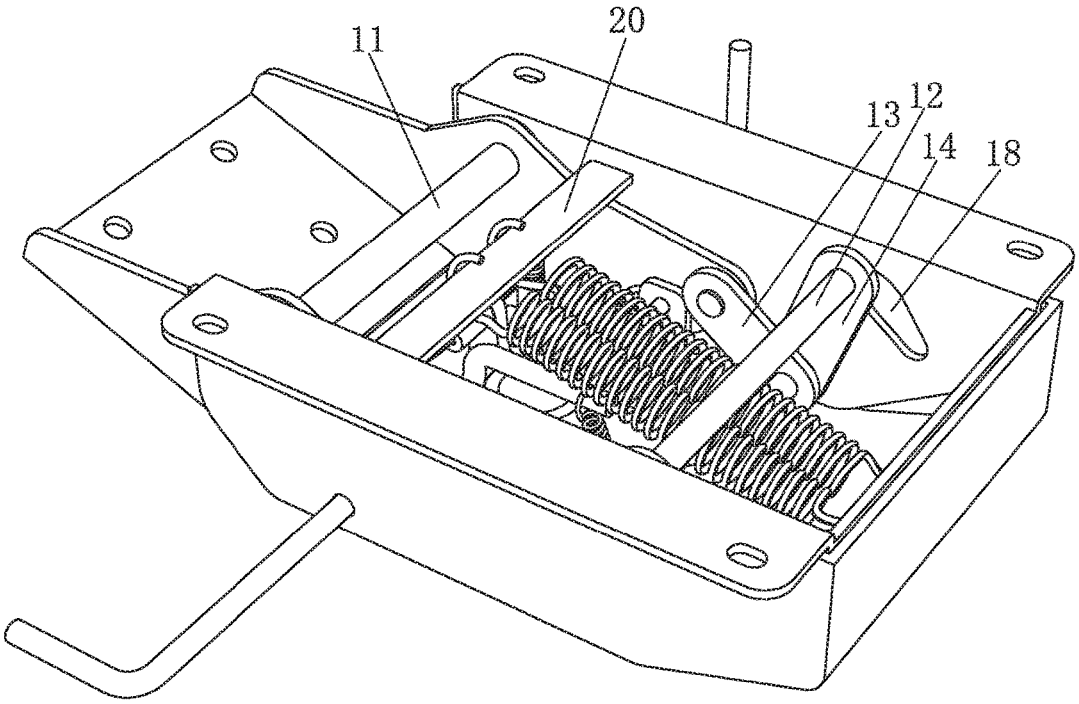
FIG. 3 is the schematic diagram where the tilting plate and the bracket are under the initial state in embodiment 1.

A first shaft hole 9 and a second shaft hole 10 are symmetrically arranged at the back end and the front end of the support plates 5 at two sides of the base 1, the middle of the tilting plate 3 is provided with a first pin shaft 11 in a penetrating way, the first pin shaft 11 is taken as the rotating fulcrum of the tilting plate 3, the first pin shaft 11 is an integrated long shaft, and two ends of the first pin shaft 11 are inserted into the first shaft hole 9 after respectively penetrating through the tilting plate 3 and the bracket 2 in sequence; a first connecting rod 13 and a second connecting rod 14 are symmetrically arranged at two sides at the front of the tilting plate 3, as shown in FIG. 2, the first connecting rod 13 is arranged in a tilting way towards the direction which is near to the tilting plate 3 from bottom to top, the second rod 14 is arranged in a tilting way towards the direction which departs from the tilting plate 3 from bottom to top, and when the bracket 2 moves, the inclined angle between the connecting rod 14 and the plumb line is always not more than 90 degrees.

One end of the first connecting rod 13 is hinged with the front end of the tilting plate 3 through a fourth pin shaft 16, the other end of the first connecting rod 13 is hinged with one end of the second rod 14 through a third pin shaft 15, the third pin shaft 15 is inserted into the bracket 2, the other end of the second connecting rod 14 is provided with a second pin shaft 12 in a penetrating way, the second pin shaft 12 penetrates through the bracket 2 and is inserted into the second shaft hole 10, the second pin shaft 12 is an integrated long shaft, and two ends of the second pin shaft 12 are inserted into the second shaft hole 10 after respectively penetrating through the second connecting rod 14 and the bracket 2 in sequence; the tilting plate 3 drives the bracket 2 move through the connecting rods, so that the basal plates 6 arranged at two sides of the bracket 2 are respectively provided with a track groove 17 which is matched with the first pin shaft 11 to guide the motion track of the bracket 2 and a hollow groove 18 which is matched with the second pin shaft 12 to avoid the second pin shaft 12 when the bracket 2 moves, the track groove 17 and the hollow groove 18 are configured to make the first pin shaft 11 and the second pin shaft 12 be capable of penetrating through the bracket 2, both of the track groove 17 and the hollow groove 18 are arranged in a titling way towards the direction which is near to the tilting plate 3, the first pin shaft 11 and the second pin shaft 12 are respectively arranged within the track groove 17 and the hollow groove 18 in a penetrating way, and the bracket 2 is connected with an elastic reset device.

The elastic reset device is a spring 19, one end of the spring 19 is connected with the bracket 2, and the other end of the spring 19 is connected with the base 1. Specifically, a cross rod 20 is arranged on the bracket 2, two ends of the cross rod 20 are fixedly connected with the two basal plates 6 of the bracket 2, the spring 19 is arranged in a tilting way, the upper end of the spring 19 hooks the cross rod 20, and the lower end of the spring 19 hooks the lower edge of the front end of the base 1. When in use, the 1-4 spring(s) 19 can be configured according to the actual requirement.

Figure 4:
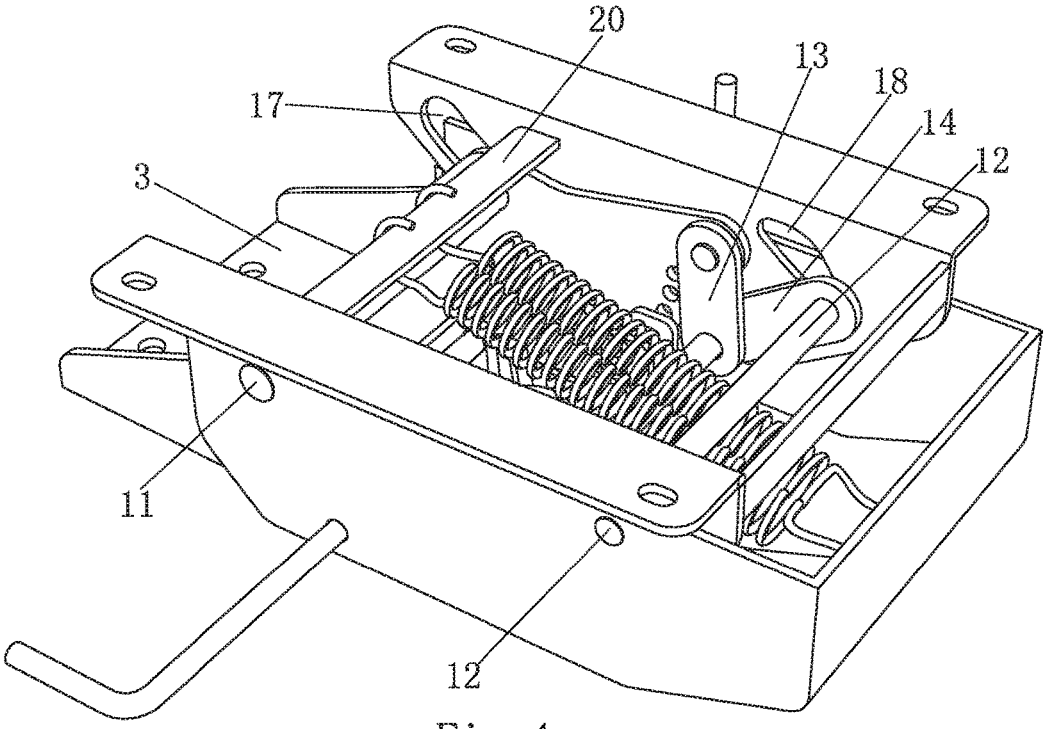
FIG. 4 is the schematic diagram where the tilting plate and the bracket are under the tilting state in embodiment 1.
Figure 5:
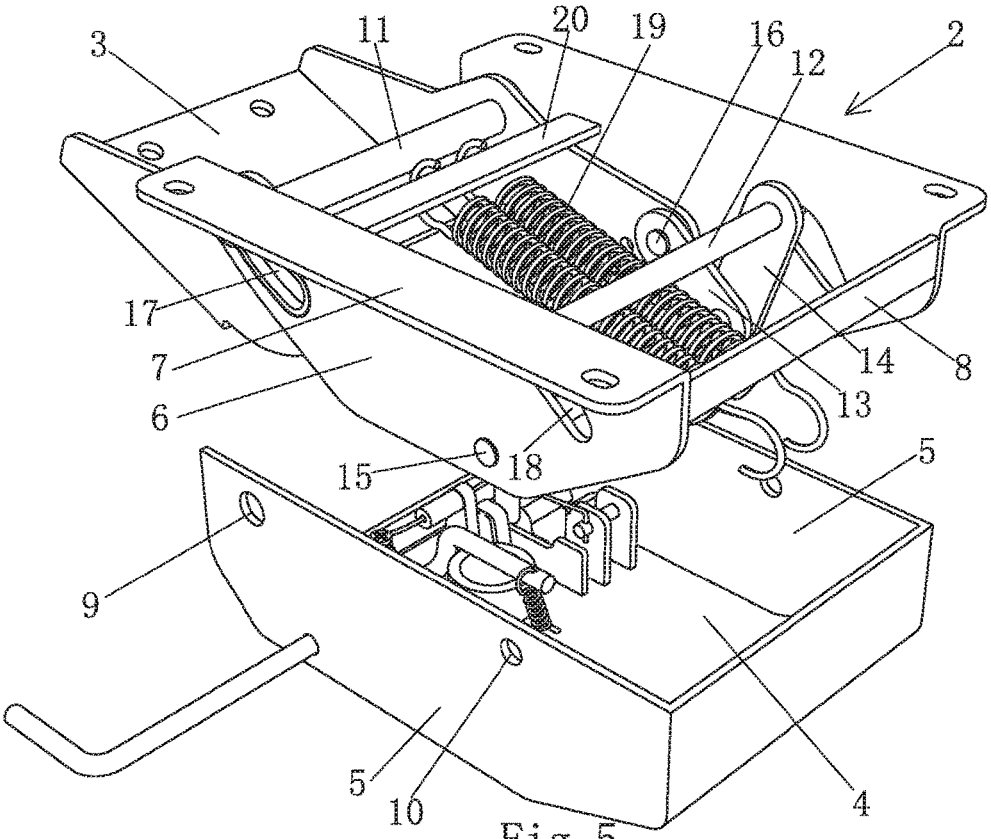
FIG. 5 is the split structure schematic diagram of the bracket and the base in embodiment 1.
Figure 6:
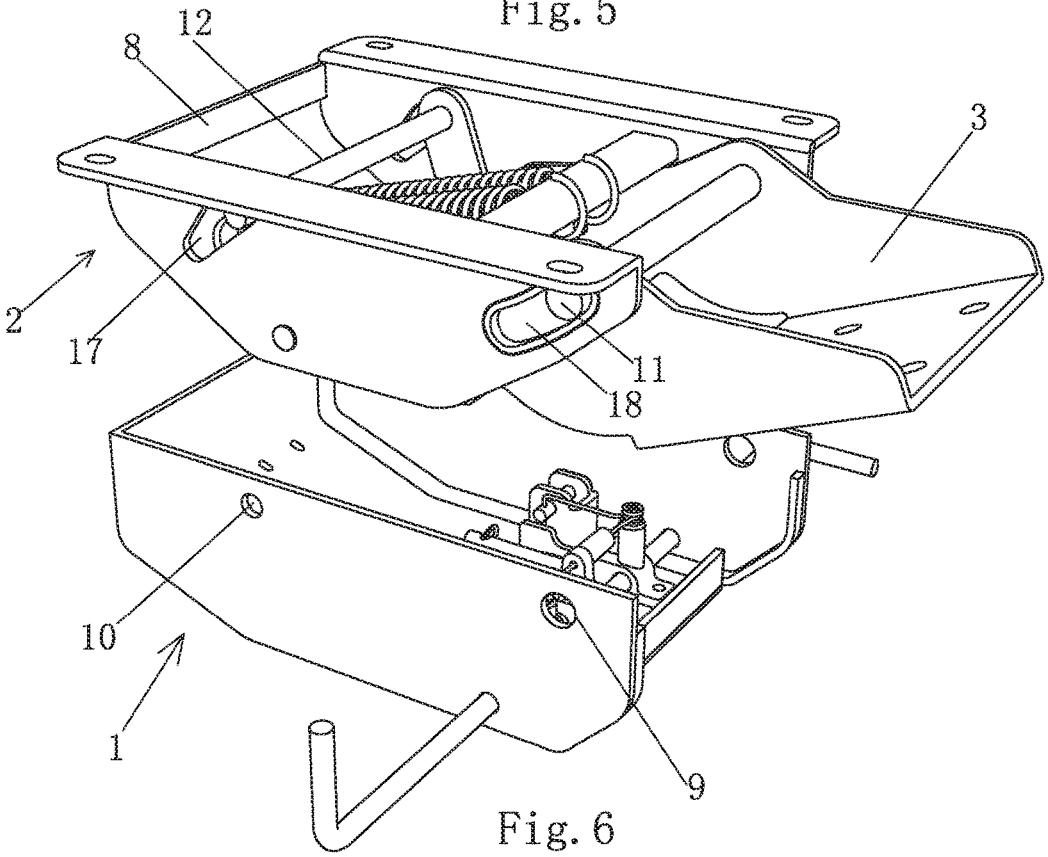
FIG. 6 is the split structure schematic diagram of the other angle of the bracket and the base in embodiment 1.

As shown in FIG. 4, when the tilting plate 3 backwards overturns, the first pin shaft 11 and the second pin shaft 12 only move relative to the bracket rather than the base, the front end of the tilting plate 3 upwards pulls the first connecting rod 13 to upwards move, the third pin shaft 15 arranged at the hinge point between the first connecting rod 13 and the second connecting rod 14 pulls the bracket 2 to move towards the oblique upper direction which is near to the tilting plate 3, and the motion track of the bracket 2 is along the track groove 17; in the whole process of moving, the inclined angle between the second connecting rod 14 and the plumb line is always not more than 90 degrees, and the third pin shaft 15 is always arranged between the plumb line of the first pin shaft 11 and the plumb line of the second pin shaft 12.

When the backrest or the tilting plate 2 tilts at the maximum angle, the distance that the bracket 2 or the chair backwards moves along with the backrest is 15-40 mm, 30 mm optimally; and the angle that the backrest backwards tilts is 10-30 degree, 21 degree optimally.

Figure 17:
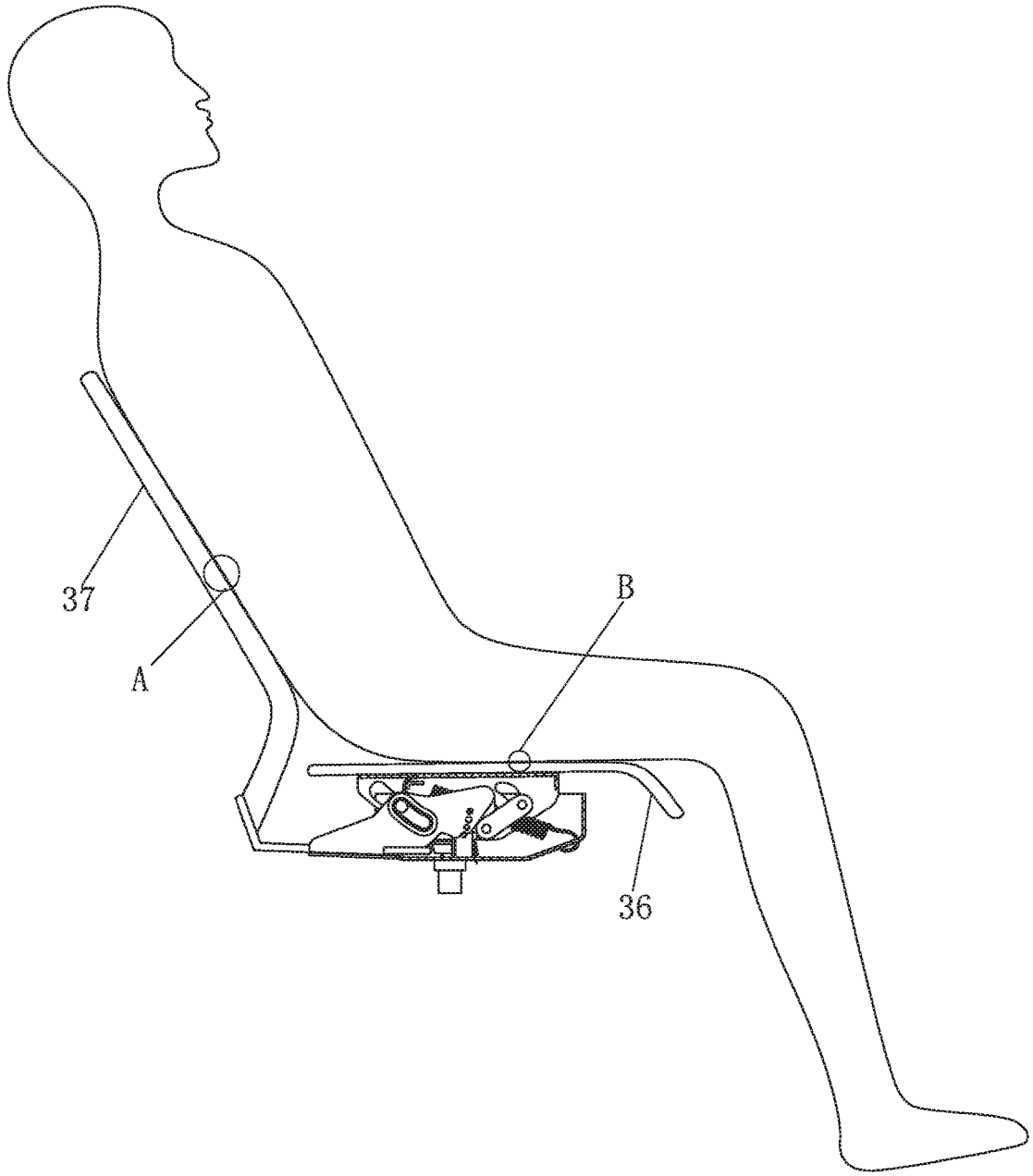
FIG. 17 is the schematic diagram where the users backwards tilt when sitting on the swivel chair.

As shown in FIG. 1, FIG. 2, FIG. 3, FIG. 5, FIG. 6 and FIG. 16, under the initial state, the users sit on the swivel chair, under the action of the pull force of the spring 19, the chair 36 and the gravity of the users, the support plate 7 presses onto the two supporting plates (not shown) of the base 1, and the basal plates 6 of the support 2 are completely arranged within the base 1; as shown in FIG. 17, when the users backwards to lean against the backrest 37, as shown in FIG. 1, FIG. 2, FIG. 3, FIG. 5, FIG. 6 and FIG. 17, the bracket 2 can drive the chair 36 linked, so that the chair 36 backwards moves along with the rotation of the backrest 37, in the process, taking the human back A and the human hip B as example, the human back A and the backrest 37 as well as the e human hip B and the chair 36 are always kept to be fixed rather than moved, so that the friction between the cloth and the human back can be avoided.

Figure 7:
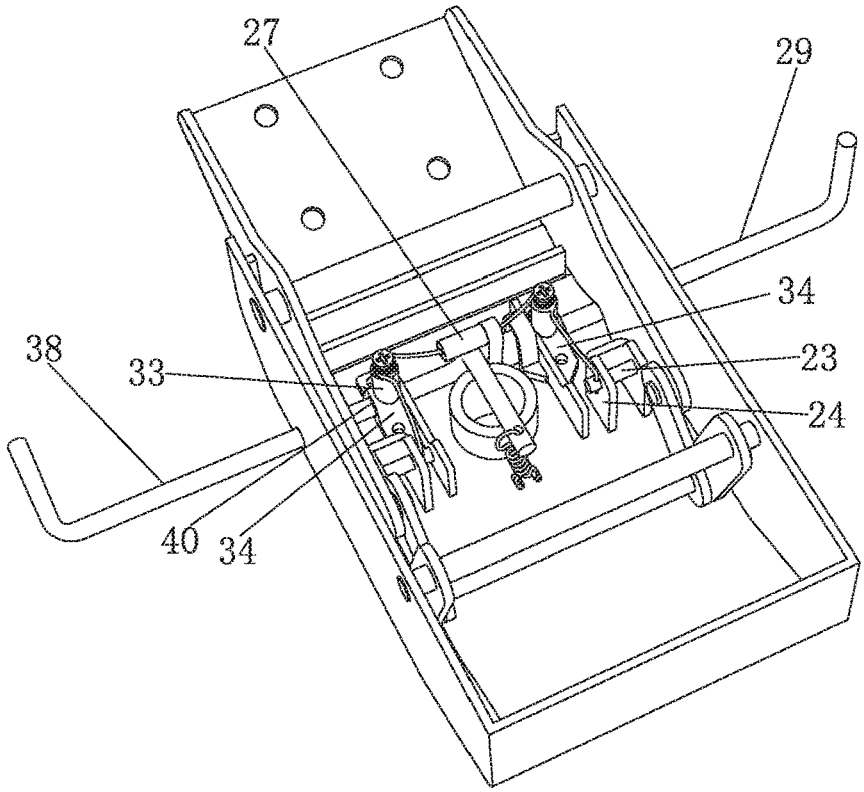
FIG. 7 is the structure schematic diagram of the backrest tilting plate locking mechanism in embodiment 1.
Figure 11:
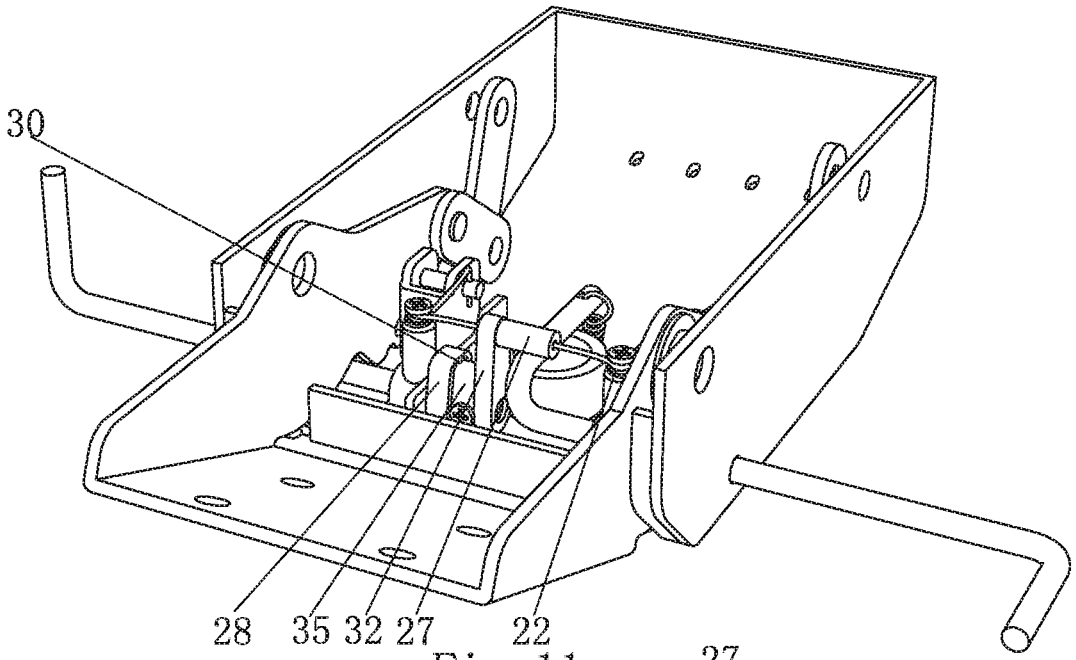
FIG. 11 is the structure schematic diagram of the other angle of the backrest tilting plate locking mechanism in embodiment 1.

As shown in FIG. 7 and FIG. 11, in order to lock the backrest at a proper position, the chassis is further provided with a backrest tilting plate locking mechanism, wherein the backrest tilting plate locking mechanism comprises a row of lock holes 21 which are symmetrically arranged on the two sides of the tilting plate 3, two torsion springs a22 symmetrically arranged on the two sides within the base 1, two plug pins 23 and two plug pin bases 24; the plug pin bases 24 are fixedly arranged on the base 1, the plug pins 23 are inserted onto the plug pin bases 24 in a sliding way and are matched with the lock holes 21, first spring arms 25 of the torsion springs a 22 are connected with the plug pins 23, and second spring arms 26 of the torsion springs a 22 are connected with a drive device used for driving the torsion springs a22 to rotate to and fro.

As shown in FIG. 7-FIG. 13, the drive device comprises a crank 27, a positioning base 28 and a stirring rod 29, wherein the positioning base 28 is fixedly connected with the base 1, the positioning base 28 is arc and is hollow in the inner part, the upper end within the positioning base 28 is provided with an arc lug boss 30 which downwards extends, the lug boss 30 is configured to divide the upper end in the positioning base 28 into two positioning grooves 31, the positioning base 28 is internally provided with a fixture block 35, the fixture block 35 has the structure which is small in the upper part and large in the lower part, the sectional area of the fixture block 35 is gradually reduced from bottom to top, the bottom surface and the top surface of the fixture block 35 are arc, the upper end of the fixture block 35 is clamped within the positioning grooves 31, two ends of the crank 27 are connected with the second spring arms 26 of the two torsion springs a22, the crank 27 is connected with the fixture block 35 through a rocker 32, one end of the stirring rod 29 is fixedly connected with the fixture block 35 after penetrating through the support plates 5 of the base 1, and the other end of the stirring rod 29 exposes out of the base 1; the stirring rod 29 is stirred forward and backward, so that the fixture block 35 moves from one positioning groove 31 into another positioning groove 31, and the fixture block 35 rotates to drive the crank 27 move, therefore, the two torsion springs a22 are driven to rotate, and under the action of the elasticity of the torsion springs a22, the first spring arms 25 drive the plug pins 23 inserted into the corresponding lock holes 21 or be withdrawn out of the lock holes 21 to realize the lock and the unlock of the plug pins.

The drive device further comprises two stand columns 33 for installing the torsion springs a22, the upper end of each stand column 33 is provided with a screw 39 in a screwing way, the torsion springs a22 are arranged onto the screws 39 in a covering way, the lower end of each stand column 33 is fixedly connected with the base plate 4 of the base 1 through arc bridges 34, a shaft hole 40 is formed between each arc bridge 34 and the bottom surface of the base 1, and the stirring rod 29 penetrates through one of the arc bridges to be fixed with the fixture block 35. Meanwhile, the chassis further comprises a press rod 38 used for controlling an air rod, wherein the press rod 38 is overlapped at the installing positron of the air rod after penetrating through the base and penetrating through another arc bridge.

Figure 8:
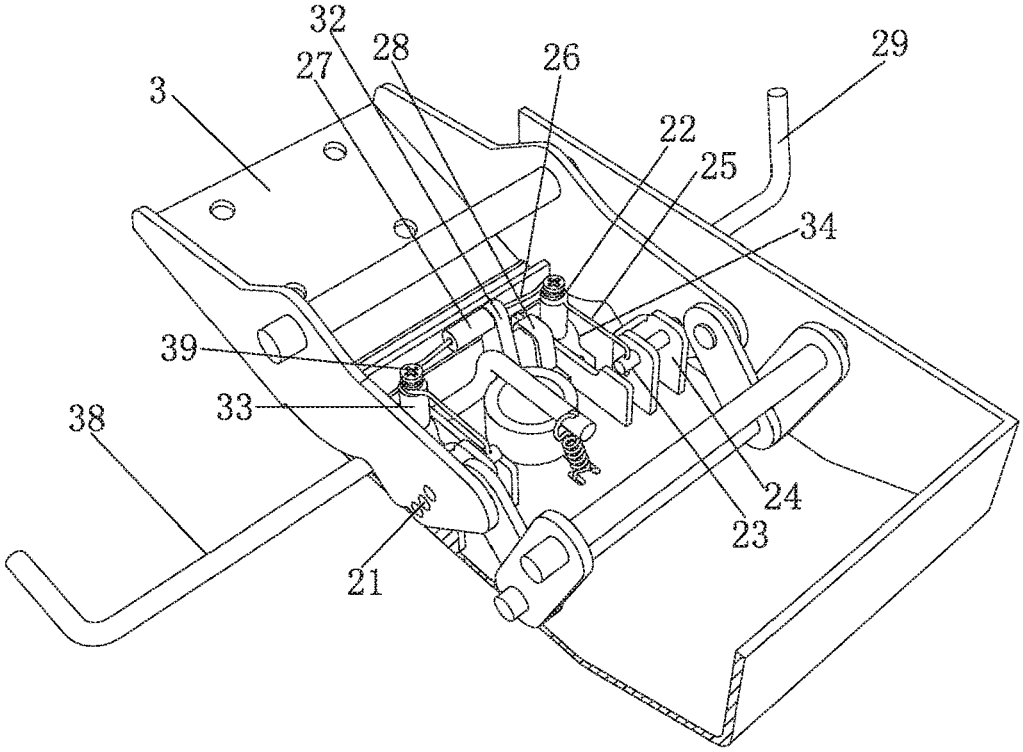
FIG. 8 is the schematic diagram where the plug pin of the backrest tilting plate locking mechanism is unlocked in embodiment 1.
Figure 9:
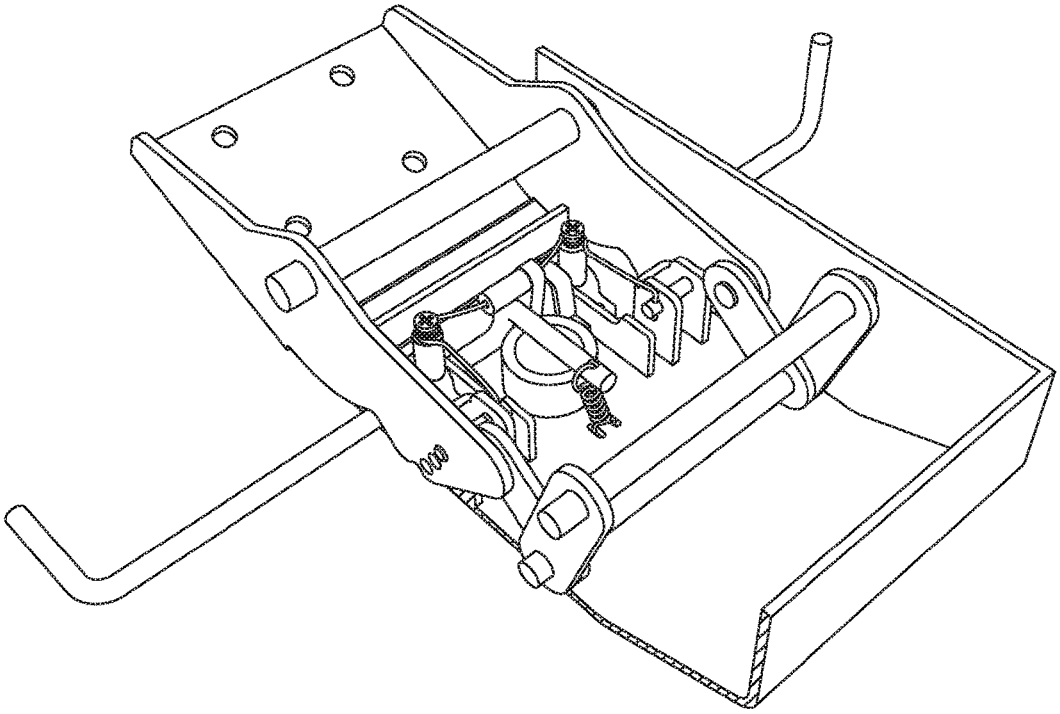
FIG. 9 is the schematic diagram where the plug pin of the backrest tilting plate locking mechanism is locked at the initial angle in embodiment 1.
Figure 12:
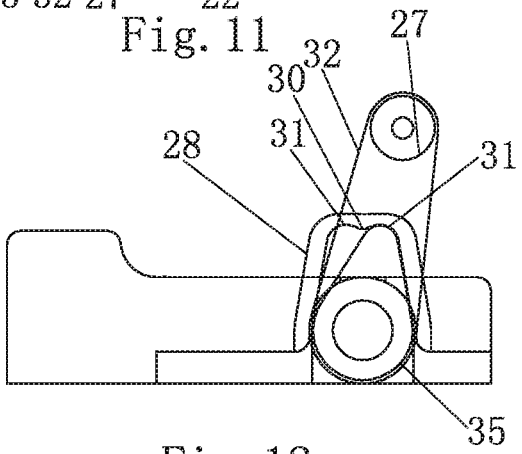
FIG. 12 is the match structure schematic diagram of the crank, the positioning base and the fixture block in the drive device under the status that the plug pin is unlocked in embodiment 1.
Figure 13:
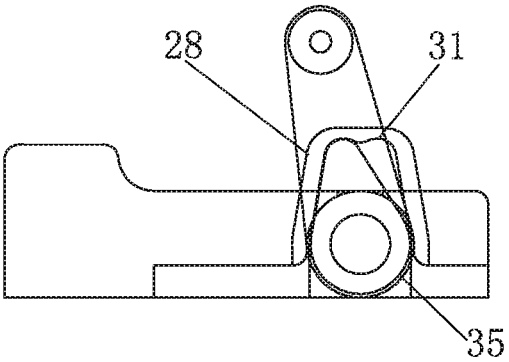
FIG. 13 is the match structure schematic diagram of the crank, the positioning base and the fixture block in the drive device under the status that the plug pin is locked in embodiment 1.

As shown in FIG. 8, under the state of unlock, the plug pin 23 departs from the lock holes 21, so that the users can lean against the backrest at any angles when sitting on the chair; as shown FIG. 9 and FIG. 13, under the state that the chair is under the initial position when not been leaned and locked, the stirring rod 29 is stirred, so that the upper end of the fixture block 35 overcomes the resistance of the lug boss 30 to move from the right positioning groove 31 to the left positioning groove 31, and the fixture block 35 rotates to drive the crank 27 move, therefore, the two torsion springs a22 are driven to move at the same time, and under the elastic function of the torsion springs a22, the first spring arm 25 pulls the plug pin 23 to be inserted into the corresponding lock holes 21 to lock the plug pin 23. When the backrest is needed to be adjusted into the proper position, the stirring rod 29 is stirred in the opposite direction, as shown in FIG. 8 and FIG. 12, so that the upper end of the fixture block 35 overcomes the resistance of lug boss 30 to move from the left positioning groove 31 to the right positioning groove 31, and the torsion springs a22 rotate to drive the plug pin 23 withdrawn out of the lock holes 21, meanwhile, the backrest can be leaned at the proper position, and when the proper position is needed to be kept, the action is repeated, so that the plug pin 23 is inserted into the corresponding lock holes 23 to be locked.

Figure 10:
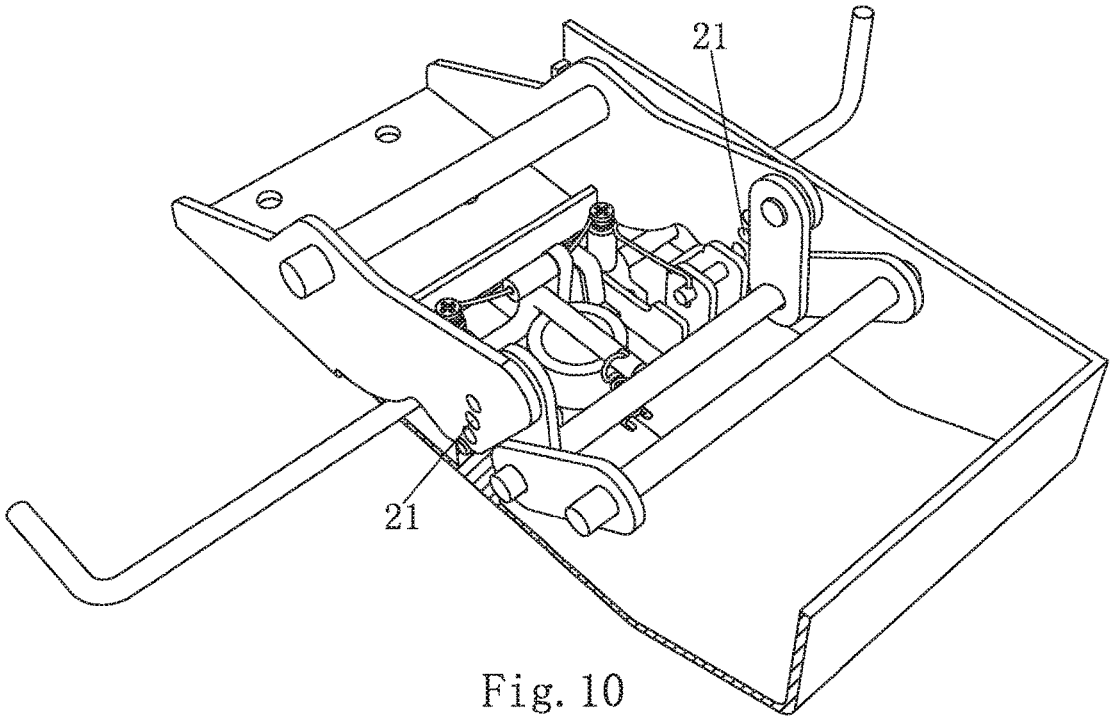
FIG. 10 is the schematic diagram where the plug pin of the backrest tilting plate locking mechanism is locked at the maximum angle in embodiment 1.

FIG. 9 shows the situation that the plug pin 23 is inserted into the upmost insert hole to be locked when the backrest is not tilted; as shown in FIG. 10, when the backrest is under the maximum tilt angle and locked, the plug pin 23 is inserted into the bottommost insert hole.

To clarify, the backrest tilting plate locking mechanism is not only limited by the mechanical mechanism but also can be locked at any position by the air rod; the elastic reset device can be a metal spring, the rubber spring or the air rod, and the combination of the metal spring, the rubber spring and the air rod.

Figure 14:
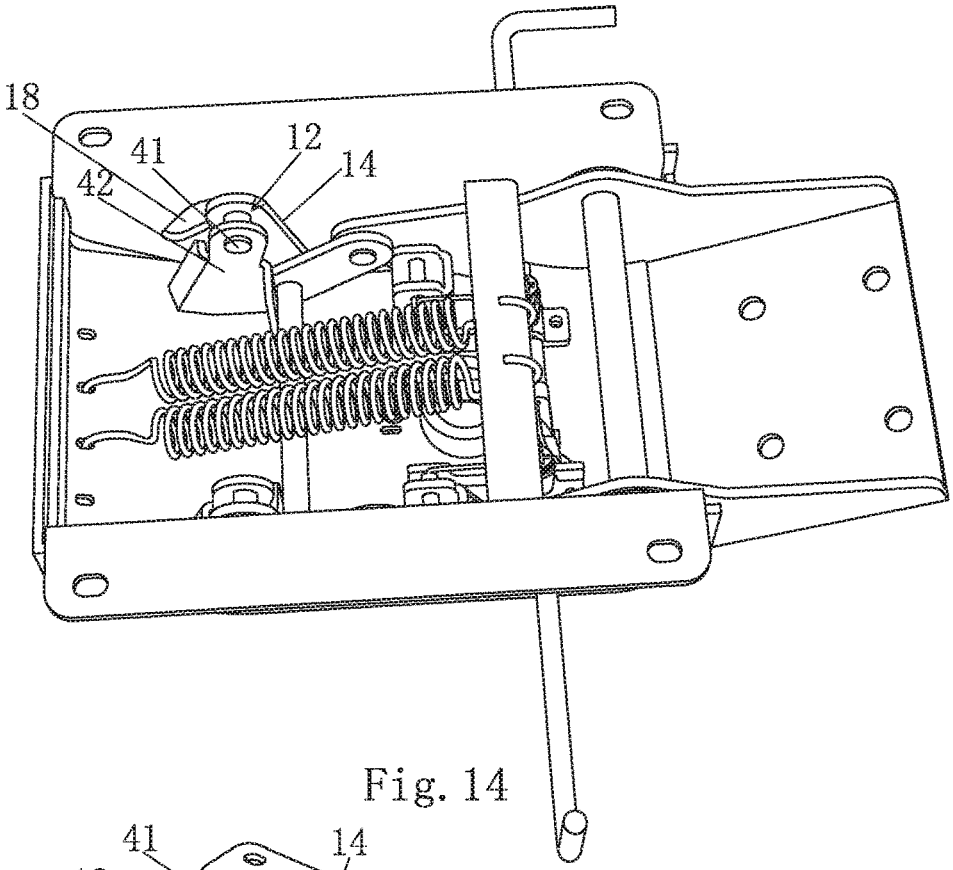
FIG. 14 is the three-dimensional structure schematic diagram of the chassis in embodiment 2.
Figure 15:
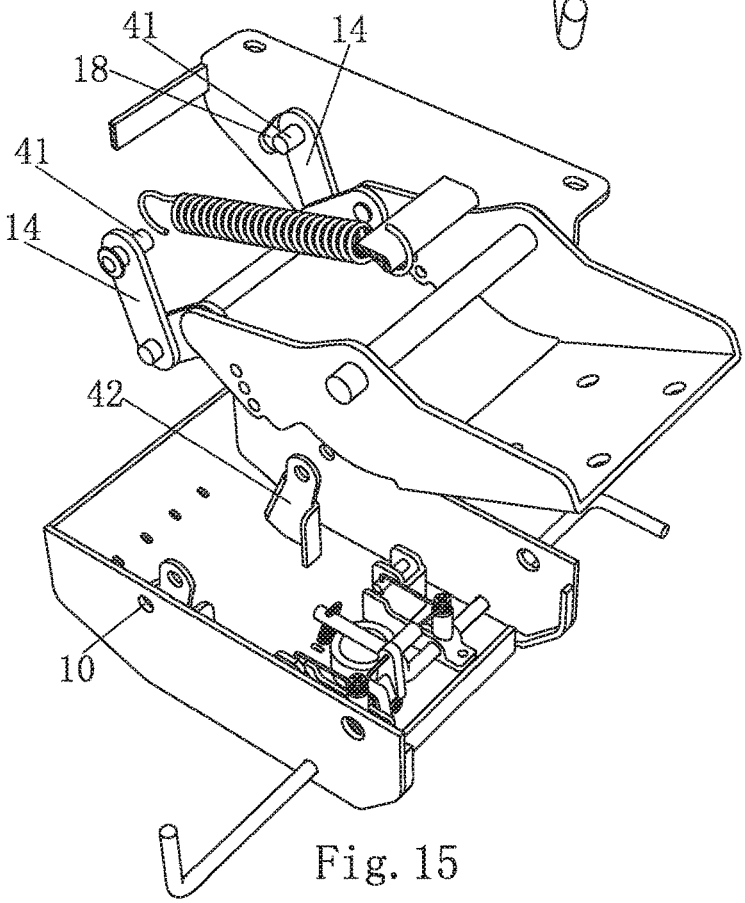
FIG. 15 is the split structure schematic diagram of the bracket and the base in embodiment 2.
Figure 16:
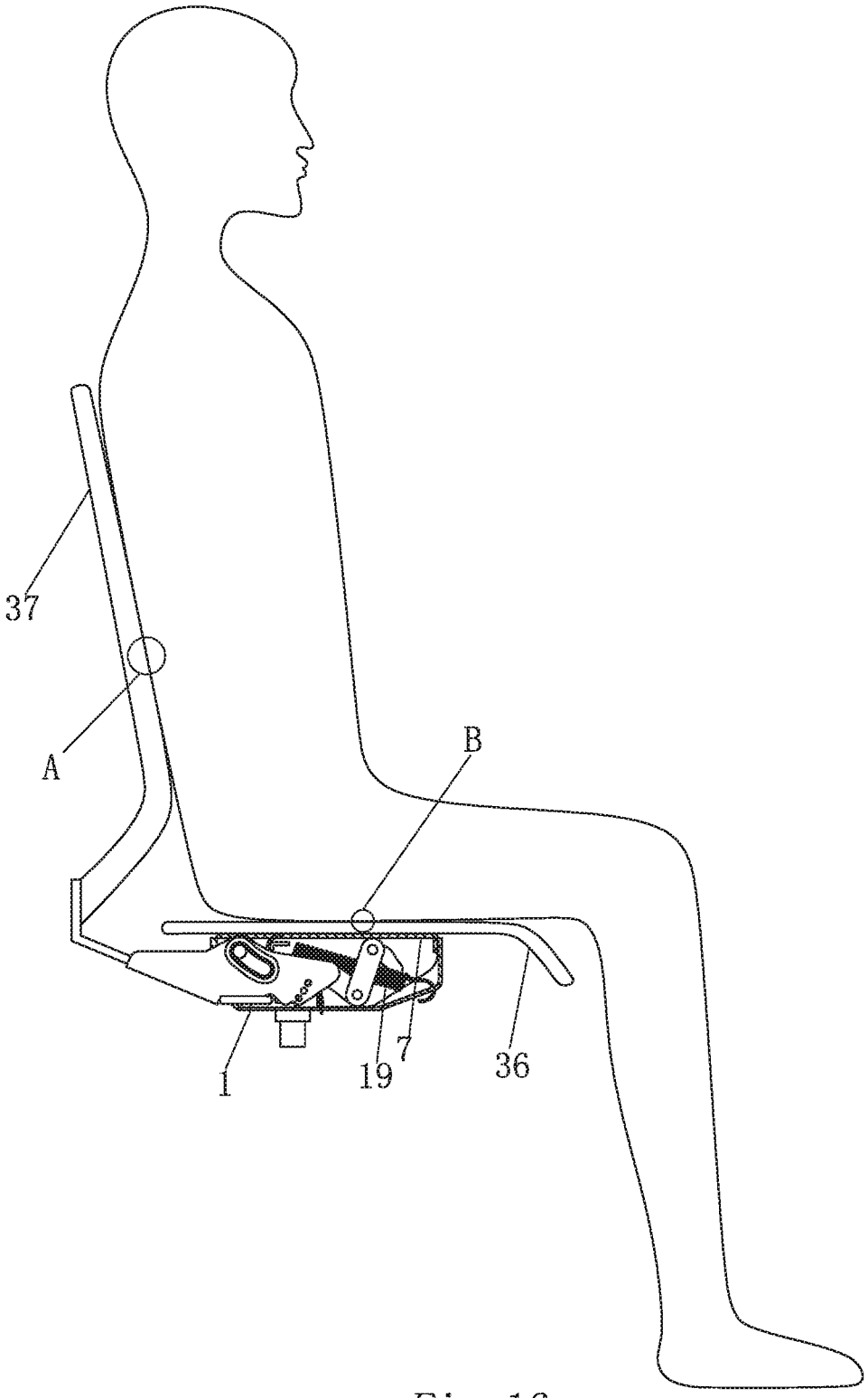
FIG. 16 is the schematic diagram where the users do not tilt when sitting on the swivel chair.

Embodiment 2: the difference between the embodiment 1 and the embodiment is as follows: as shown in FIG. 14 and FIG. 15, the second pin shaft 12 is two independent small shafts 41, two supports 42 are correspondingly fixed on the base 1, one end of each small shaft 41 is inserted into the second shaft hole 10 after penetrating the second connecting rod 14 and the hollow groove 18, and the other end of each small shaft 41 is inserted into the corresponding support 42. Therefore, relative to the mode of an integrated long shaft, the spring 19 can be avoided, and the baffle to the spring 19 can be avoided.

Figure 18:
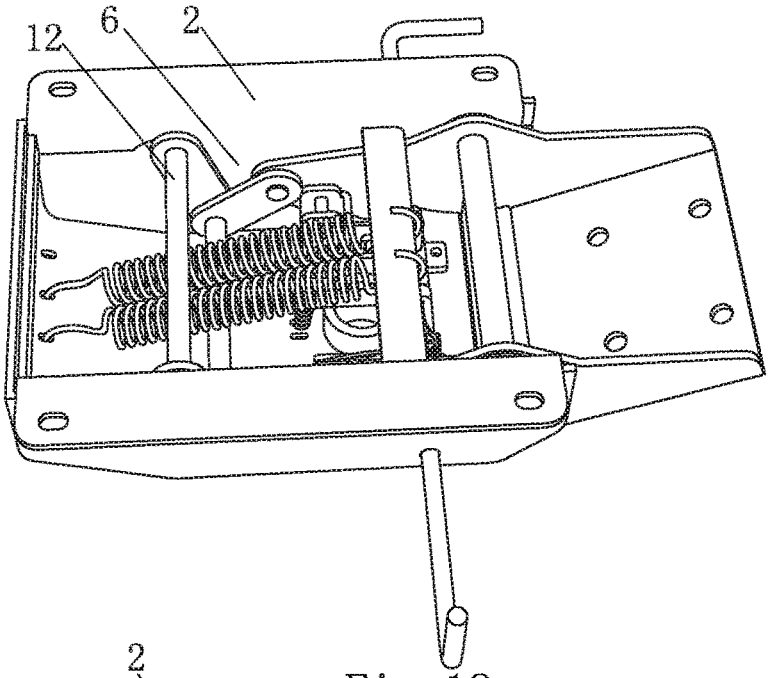
FIG. 18 is the three-dimensional structure schematic diagram of the chassis in embodiment 3.
Figure 19:
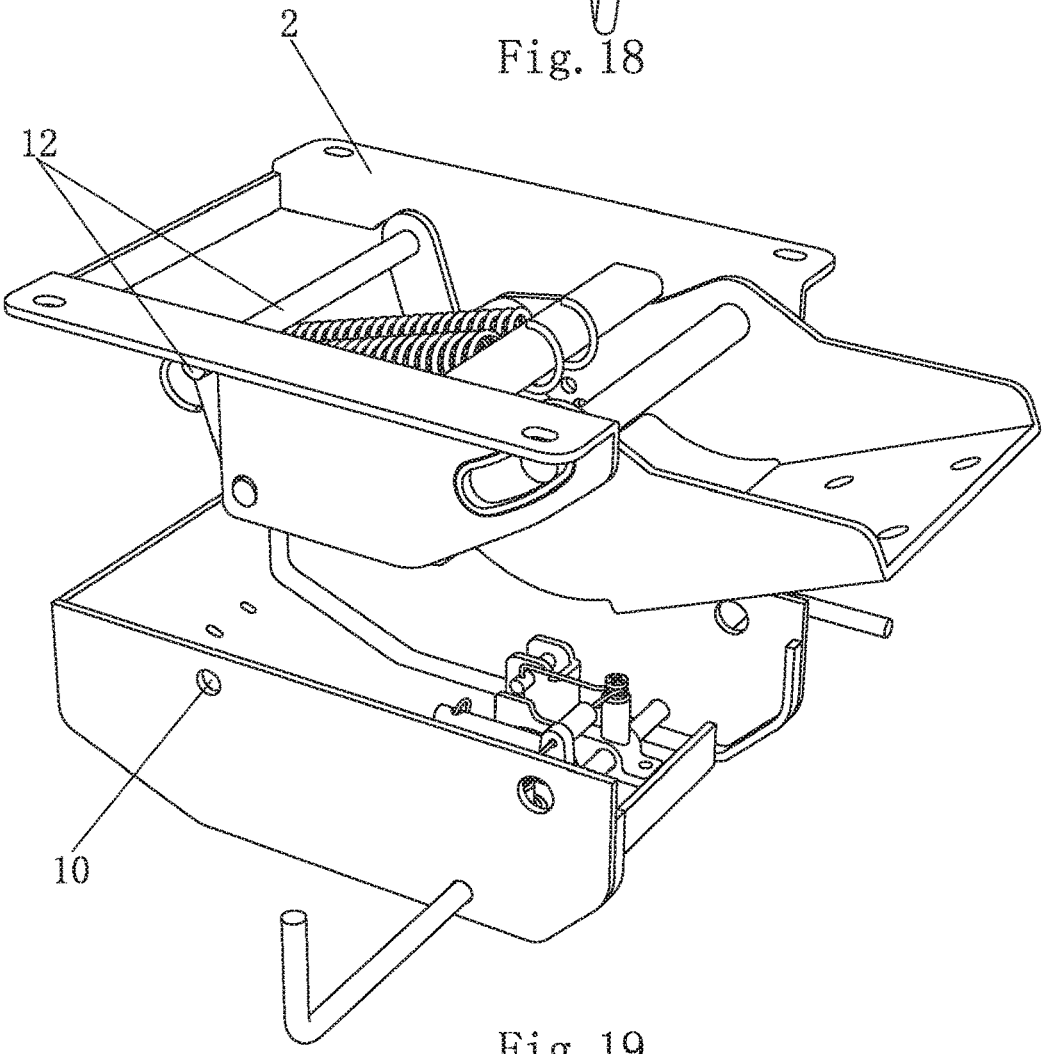
FIG. 19 is the split structure schematic diagram of the chassis in embodiment 3.

Embodiment 3: the difference between the embodiment and the embodiment 1 is as follows: as shown in FIG. 18 and FIG. 19, the part of the basal plates 6 arranged at two sides of the bracket 2, which interferes the second shaft hole 10 and the second plug pin 12, is cut, so that the bracket avoids the second shaft hole 10 and the second plug pin 12, and the second plug pin 12 is directly inserted into the second shaft hole 10.

Figure 20:
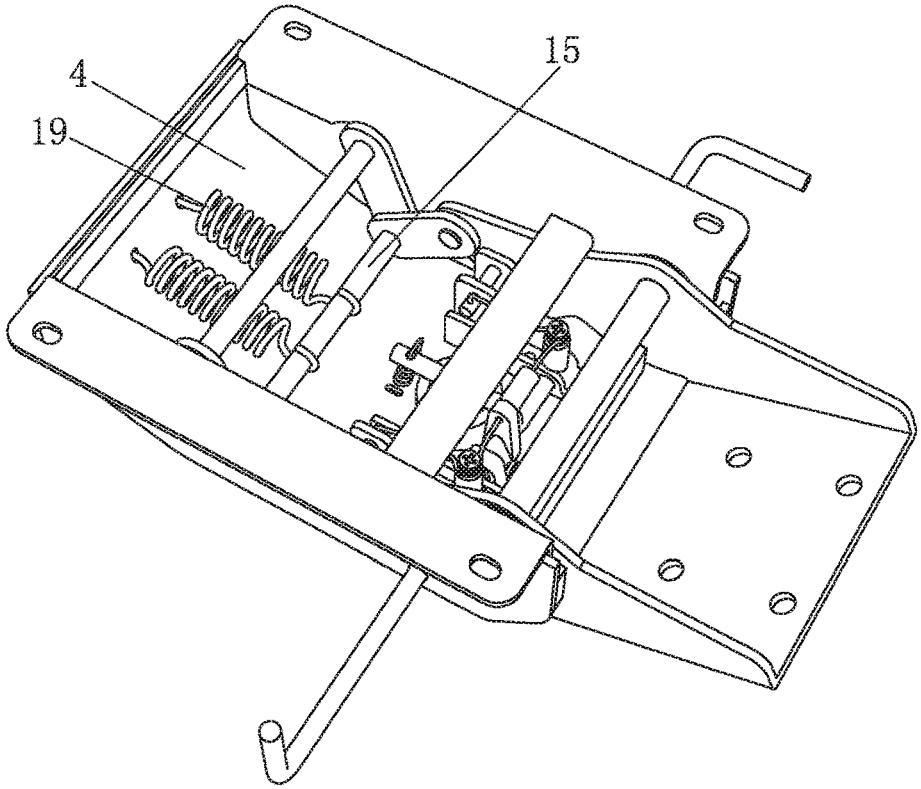
FIG. 20 is the structure schematic diagram of the chassis in embodiment 4.

Embodiment 4: the difference between the embodiment and the embodiment 1 is as follows: as shown in FIG. 20, the third pin shaft 15 is connected with the elastic reset device, the third pin shaft 15 is an integrated long shaft, the elastic reset device is the spring 19, one end of the spring 19 hooks onto the third pin shaft 15, and the other end of the spring 19 hooks the base plate 4 of the base 1.

Figure 21:
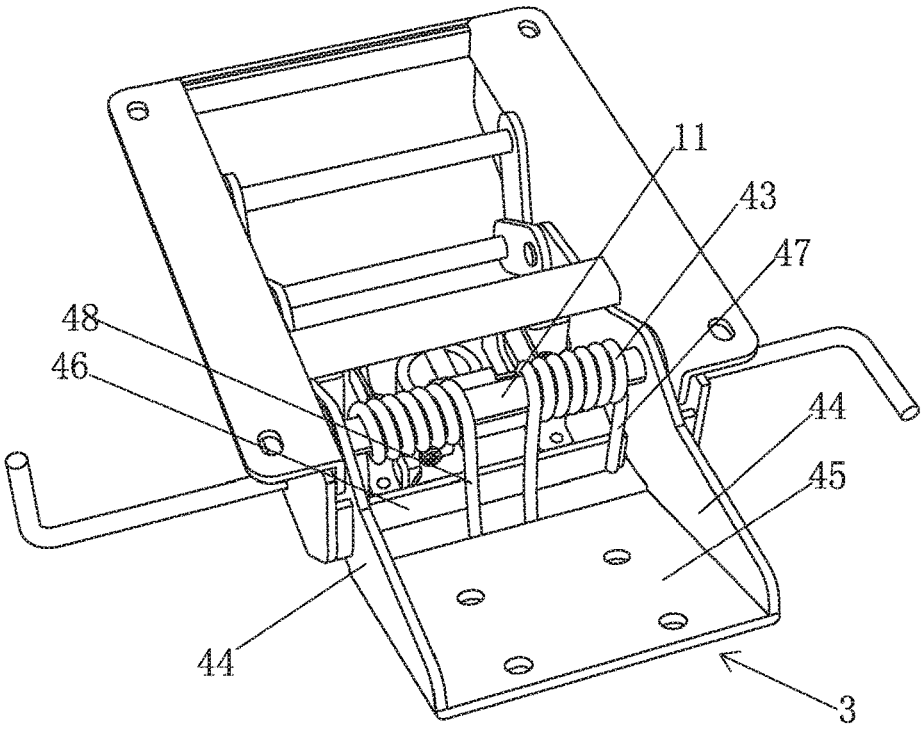
FIG. 21 is the structure schematic diagram of the chassis in embodiment 5.

Embodiment 5: the difference between the embodiment and the embodiment 1 is as follows: as shown in FIG. 21, the elastic reset device is a torsion spring b43, the torsion spring b43 is arranged on the first pin shaft 11 in a covering way, the tilting plate 3 comprises two side plates 44 which are in parallel with each other at intervals and a connecting plate 45 which is connected with the two side plates 44 and the backrest, the connecting plate 45 is arranged outside the base, a baffle plate 46 is fixedly arranged on the base plate 4 of the base, one torsion arm 47 of the torsion spring b leans against the baffle plate 46, and the other torsion arm 48 of the torsion spring b leans against the connecting plate 45.

Figure 22:
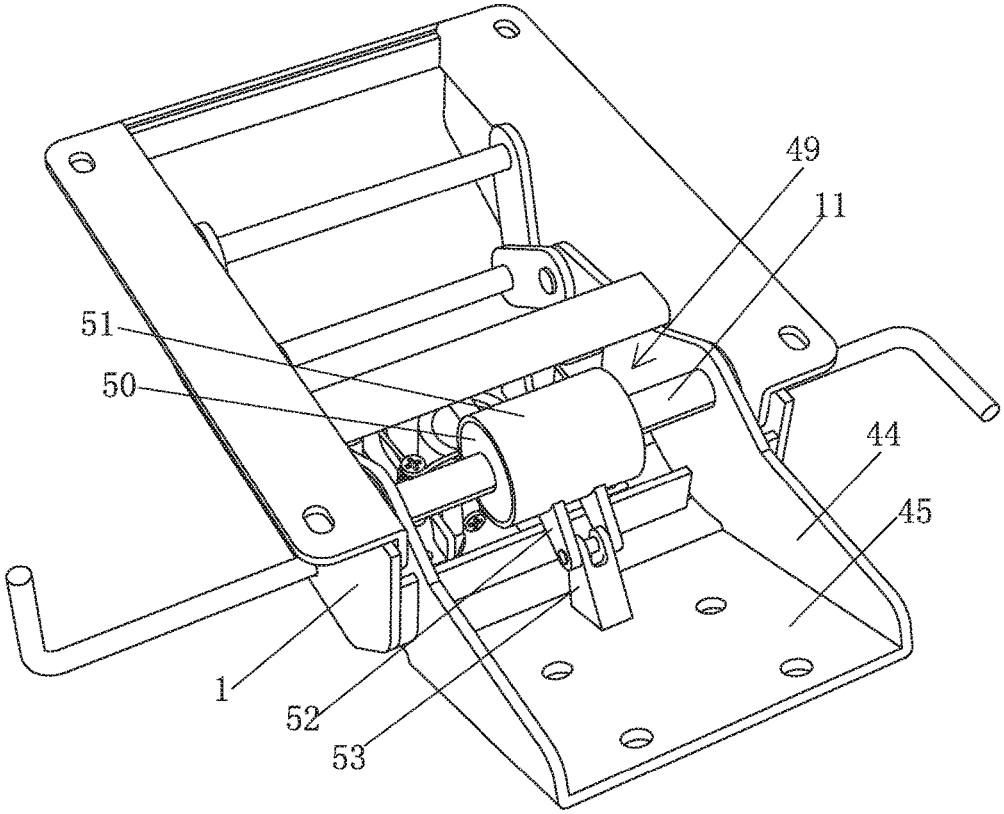
FIG. 22 is the structure schematic diagram of the chassis in embodiment 6.

Embodiment 6: the difference between the embodiment and the embodiment 1 is as follows: as shown in FIG. 22, the elastic reset device is a rubber spring 49 which is cylindrical in the whole, the rubber spring 49 comprises a rubber layer 50 which is circumferentially fixed onto the first plug pin 11, a cylindrical housing 51 is fixedly sleeved outside the rubber layer 50, a pair of connecting lugs 52 are fixedly arranged on the cylindrical housing 51, the first plug pin 11 is inserted into the first shaft hole and is fixedly connected with the base 1, the tilting plate 3 comprises two sides plates 44 which are in parallel with each other at intervals and a connecting plate 45 which is connected with the two sides plates 44 and connected with the backrest, the connecting plate 45 is arranged outside the base 1, a base body 53 is fixedly arranged on the connecting plate 45, and the connecting lugs 52 are hinged with the base body 53.

Figure 23:
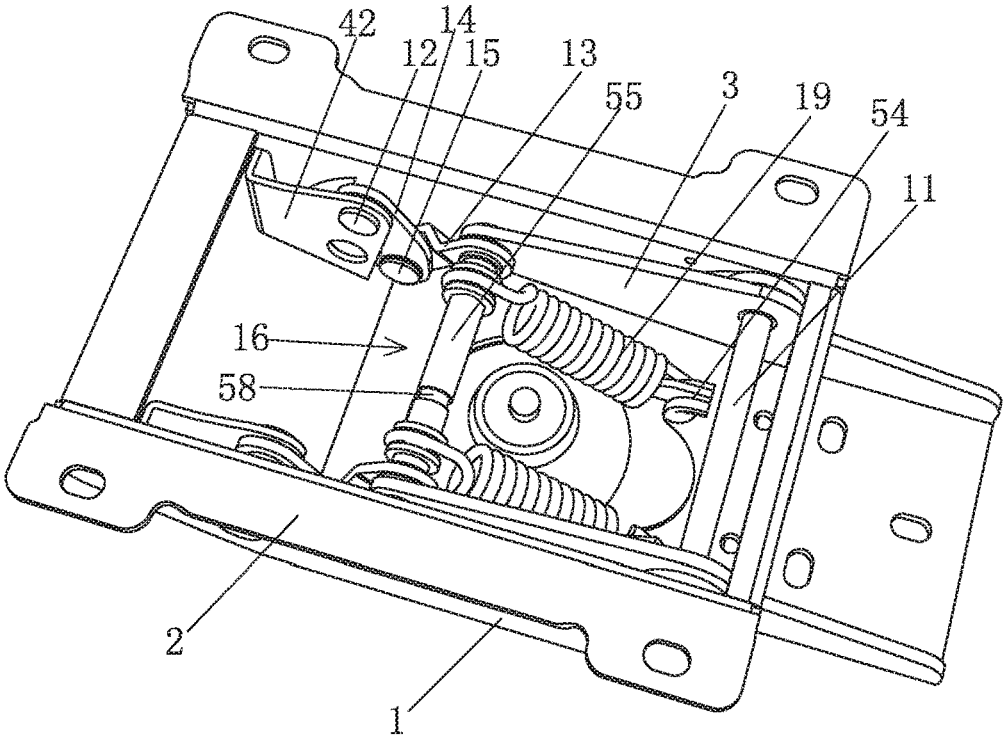
FIG. 23 is the local structure schematic diagram of the chassis in embodiment 7.
Figure 24:
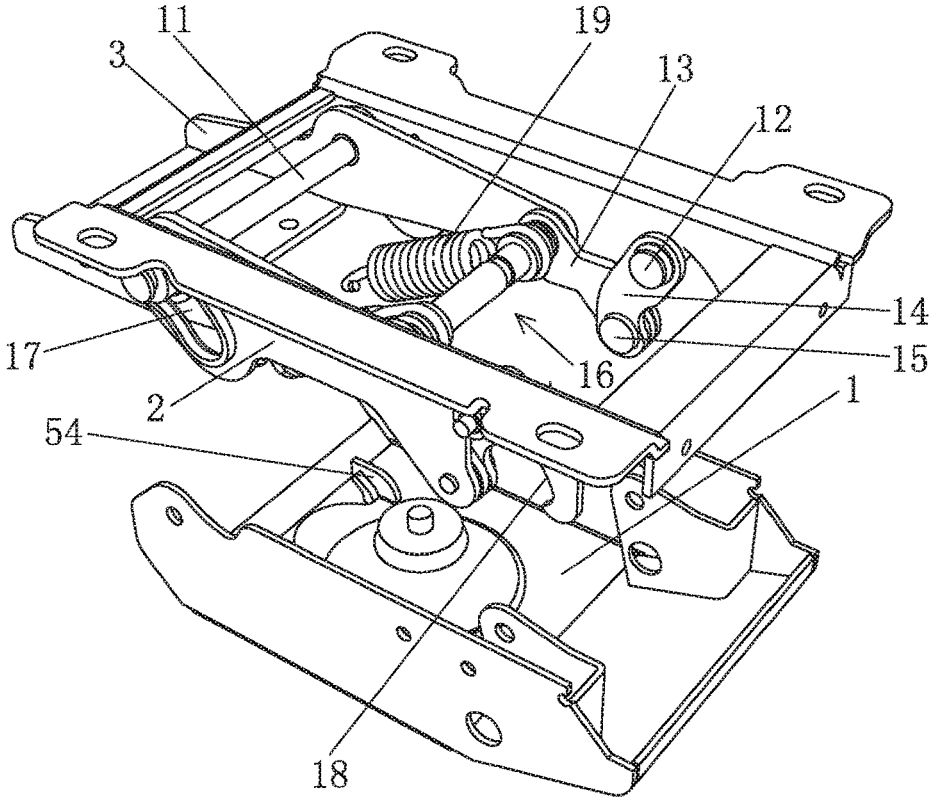
FIG. 24 is the exploded view of FIG. 23.

Embodiment 7: the difference between the embodiment and the embodiment 1 is as follows: as shown in FIG. 23 and FIG. 24, the third pin shaft 15 is two independent short shafts, the fourth pin shaft 16 is an integrated long shaft, and two ends of the fourth pin shaft 16 are respectively connected with one end of the first connecting rod 13 and the front end of the tilting plate 3.

Meanwhile, the fourth pin shaft 16 is connected with an elastic reset device, the elastic reset device is a spring 19, one end of the spring 19 is connected with the fourth pin shaft 16, and the other end of the spring 19 hooks the base 1, specifically, the position where the other end of the spring 19 is connected with the base 1 is arranged within the region of the back end of the base 1, which is far away from the first connecting rod 13 and the second connecting rod 14, a hook 54 is fixedly arranged at the region of the back end of the base 1, and the other end of the spring 19 hooks the hook 54.

In order to avoid the noise caused by the contact of the metals, a plastic sleeve 55 is covered on the fourth pin shaft 16, one end of the spring 19 hooks onto the plastic sleeve 55, and the number of the springs 19 can be selected according to actual need.

Embodiment 8: the difference between the embodiment and the embodiment 1 or the embodiment 2 is as follows: as shown in FIG. 23 and FIG. 24, the fourth pin shaft 16 is an integrated long shaft, and two ends of the fourth pin shaft 16 are respectively connected with one end of the first connecting rod 13 and the front end of the tilting plate 3.

Meanwhile, the fourth pin shaft 16 is connected with an elastic reset device, the elastic reset device is a spring 19, one end of the spring 19 is connected with the fourth pin shaft 16, and the other end of the spring 19 hooks the base 1, specifically, the position where the other end of the spring 19 is connected with the base 1 is arranged within the region of the back end of the base 1, which is far away from the first connecting rod 13 and the second connecting rod 14, a hook 54 is fixedly arranged at the region of the back end of the base 1, and the other end of the spring 19 hooks the hook 54.

In order to avoid the noise caused by the contact of the metals, a plastic sleeve 55 is covered on the fourth pin shaft 16, one end of the spring 19 hooks onto the plastic sleeve 55, and the number of the springs 19 can be selected according to the factors such as the damping factor, the room size and the like.

As shown in FIG. 25-30, the structural form of the backrest tilting plate locking mechanism can be different, the backrest tilting plate locking mechanism comprises a lock plate 56, a torsion spring a22, a plug pin 23 and a plug pin base 24, wherein a row of lock holes 21 are arranged on the lock plate 56, the lock plate 56 is connected with an extension section 57 which is integrated with the lock plate 56 and is arranged on the same plane therewith, two ends of the extension section 57 are respectively connected with the first pin shaft 11 and the forth shaft pin 16 in a covering way, the extension section 57 is axially fixed relative to the forth plug pin 16, the lock plate 56 is arranged in the middle of the fourth pin shaft 16 or the position which is near to the middle, and the plane where the lock plate 56 is arranged is perpendicular to the axis of the forth plug pin 16.

Figure 25:
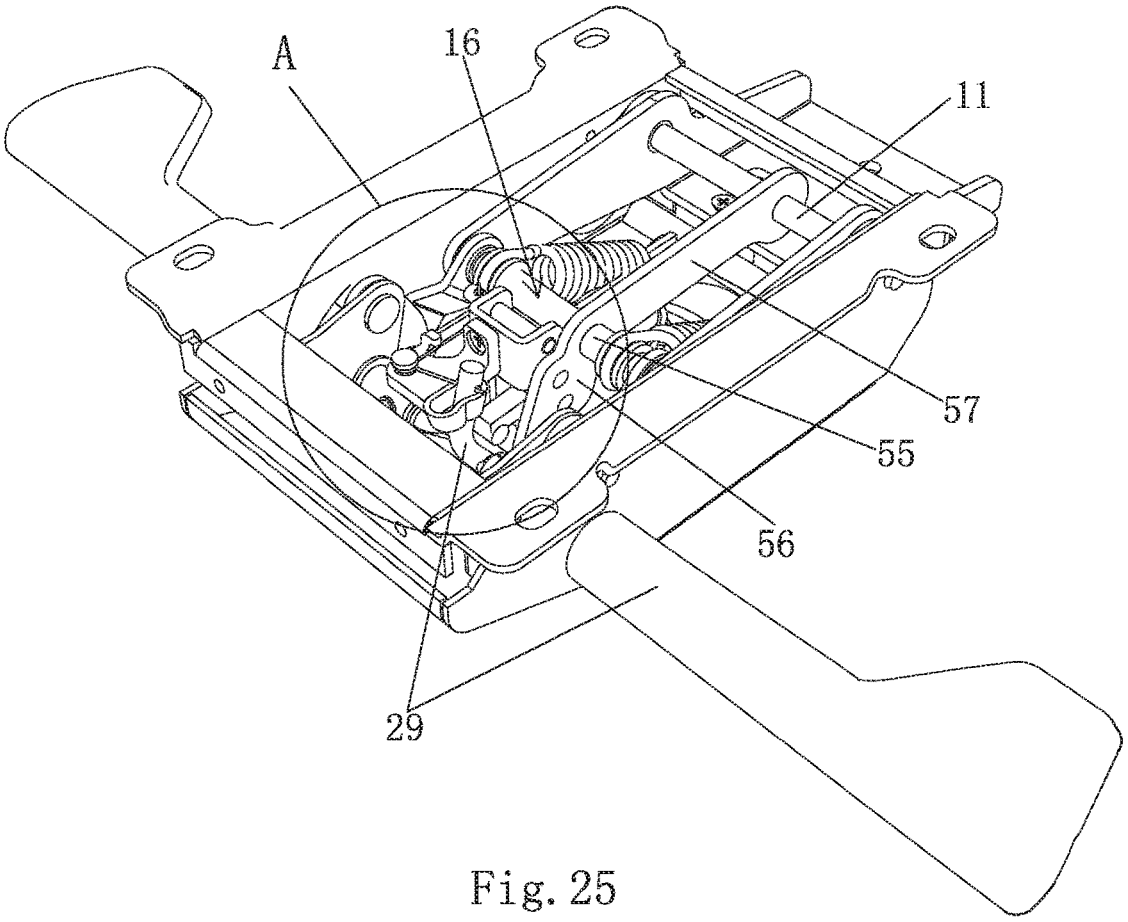
FIG. 25 is the schematic diagram where the plug pin of the backrest tilting plate locking mechanism is unlocked in embodiment 8.
Figure 26:
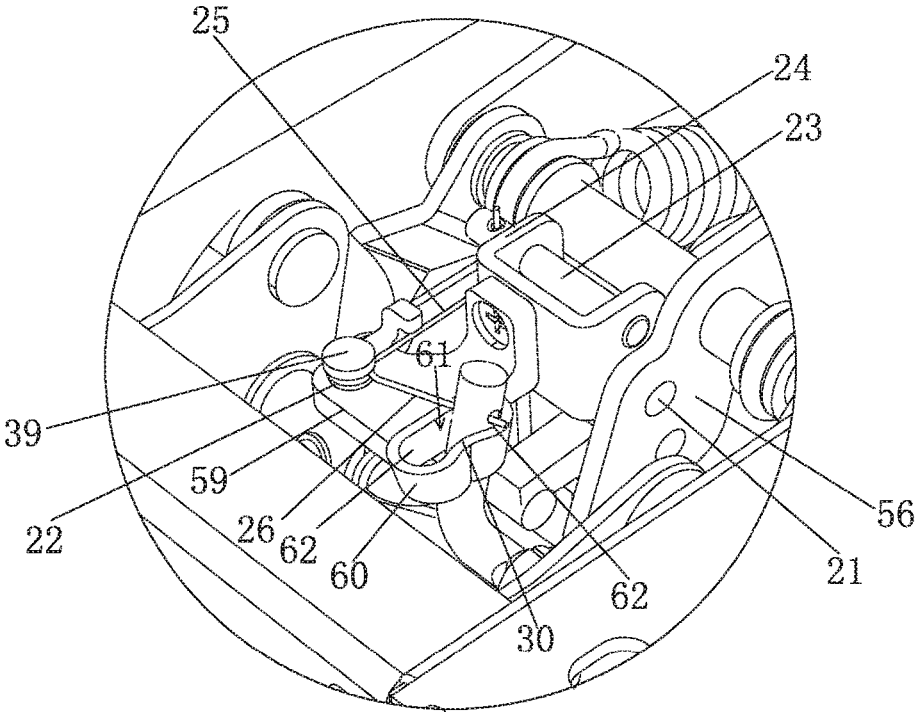
FIG. 26 is the enlarged drawing of the part A of FIG. 25.

The extension section 57 is axially fixed relative to the fourth pin shaft 16, i.e. the relative displacement between the extension section 57 and the fourth pin shaft 16 can be avoided, in order to achieve the aim, the following two modes are adopted:

As shown in FIG. 23, FIG. 25 and FIG. 26, the first mode is that the plastic sleeve 55 arranged on the fourth pin shaft 16 in a covering way is cut at the crossed position with the extension section 57 to form into a gap 58, and the extension section 57 is properly clamped within the gap 58.

The second mode is that the intersected position between the extension section 57 and the fourth pin shaft 16 is fixed in a welding way.

The plug pin base 24 is arranged beside the lock plate 56 and is fixedly connected with the base 1, the plug pin 23 is inserted onto the plug pin base 24 in a sliding way and is matched with the lock holes 21, a first spring arm 25 of the torsion spring a22 is connected with the plug pin 23, and a second spring arm 26 of the torsion spring a22 is connected with a drive device used for driving the torsion spring a22 to rotate back and forth.

The drive device comprises a support base 59, a stirring rod 29 and a positioning ring 60 which is deformable once being forced, wherein the support base 59 is fixedly arranged on the plug pin base 24, the positioning ring 60 is fixedly arranged on the side wall of the support base 59, the torsion spring a22 is covered on the screw 39, the screw 39 is fixedly arranged on the support base 59, the positioning ring 60 is internally provided with kidney holes 61, the kidney holes 61 are arranged from top to bottom, an arc lug boss 30 is arranged in the middle of the kidney holes 61, the lug boss 30 is configured to divide the inner part of the positioning ring 60 into two clamp grooves 62, one end of the stirring rod 29 extends into the poisoning ring 60 in a bending way after penetrating through the base 1, and the other end of the stirring rod 29 exposes out of the base 1; the second spring arm 26 of the torsion spring a22 is connected with the end of the stirring rod 29, which extends into the positioning ring 60, the stirring rod 29 is rotated, so that the end of the stirring rod 29, which extends into the positioning ring 60, moves from one clamp groove 62 to another clamp groove 62, therefore, the torsion spring a22 is driven to rotate at the same time, and under the action of the elastic force of the torsion spring a22, the first spring arm 25 pulls the plug pin 23 to be inserted into the corresponding lock holes 21 or withdrawn out of the lock holes 21 to lock and unlock the plug pin 23.

Figure 27:
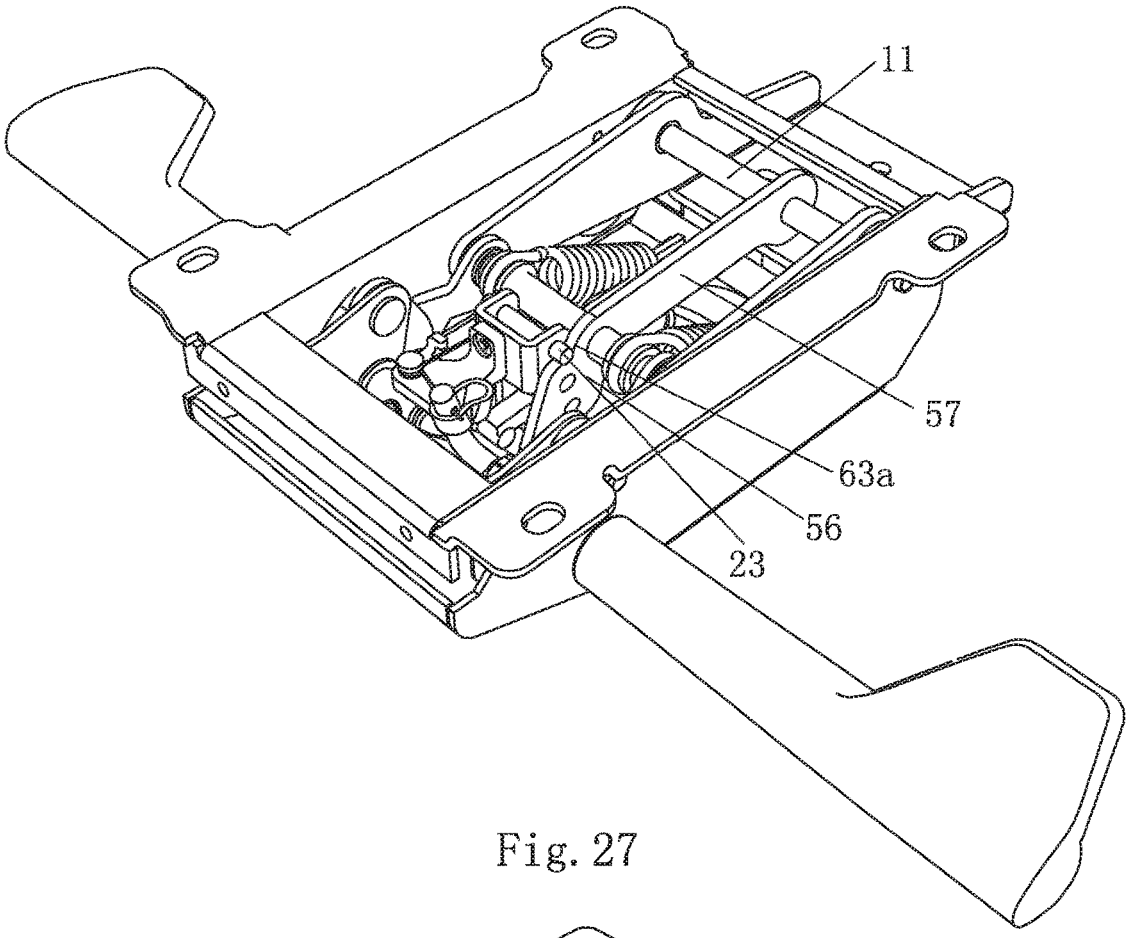
FIG. 27 is the schematic diagram of the plug pin of the backrest tilting plate locking mechanism when the tilting plate is locked at the initial angle in embodiment 8.
Figure 28:
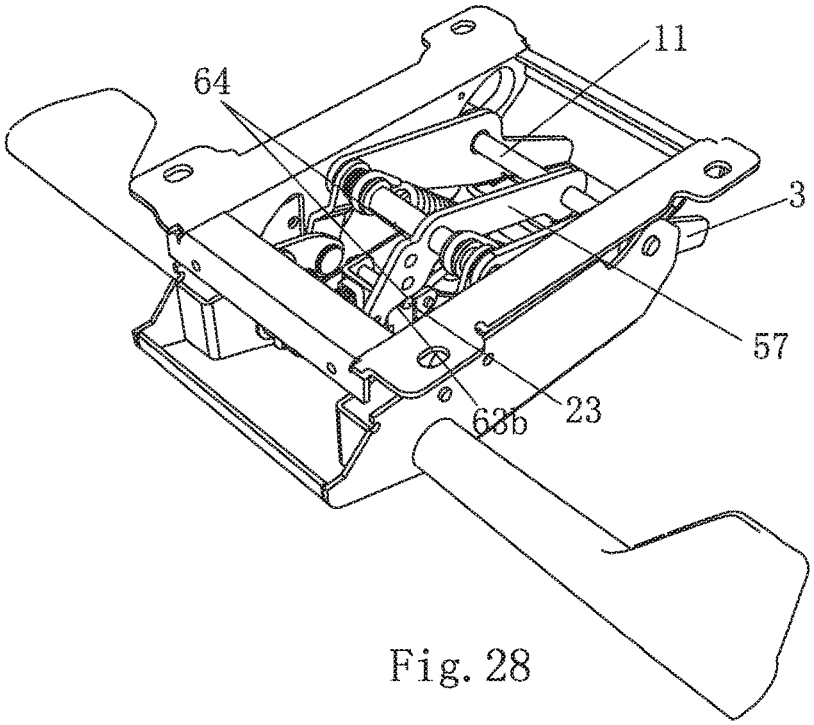
FIG. 28 is the schematic diagram of the plug pin of the backrest tilting plate locking mechanism when the tilting plate is locked at the maximum angle in embodiment 8.
Figure 29:
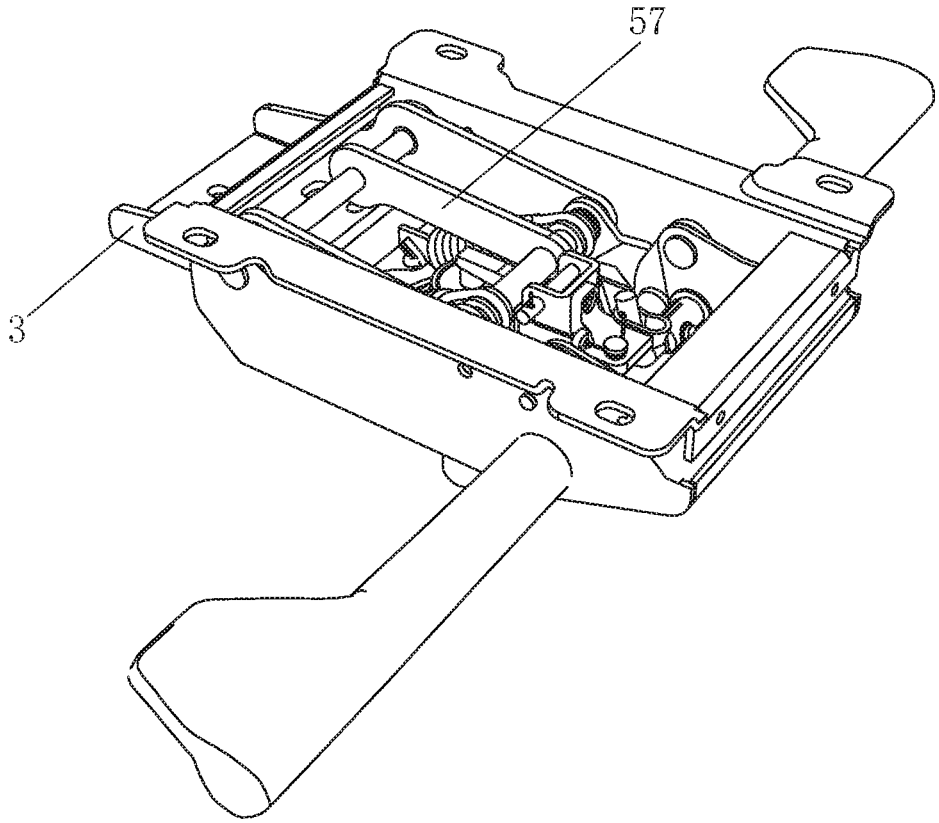
FIG. 29 is the whole structure schematic diagram of the chassis when the tilting plate is under the initial angle in embodiment 8.
Figure 30:
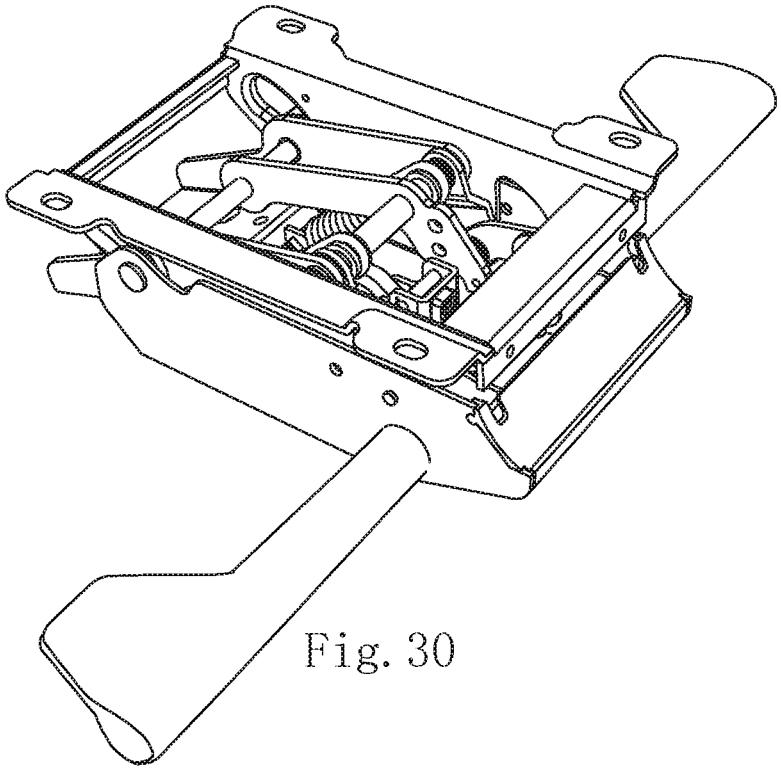
FIG. 30 is the whole structure schematic diagram of the chassis when the tilting plate is under the maximum angle in embodiment 8.

Furthermore, considering the fact that the space is limited and the position limit is carried out by the lock plate 56 maximally, as shown in FIG. 27 and FIG. 29, the upper end face 63*a* and the lower end face 63*b* of the lock plate 56 are concaved to form a gap groove 64 which is matched with the plug pin 23 in a leaning way, and the plug pin 23 outwards extends and is clamped within the gap groove 64 of the upper end face 63*a* and the lower end face 63*b* to lock the tilting plate 3 at the initial angle and the maximum angle.

Certainly, the lower end face 63*b* can be configured to be horizontal, so that the lower end face 63*b* can be matched with the plug pin 23 in a leaning way.

Embodiment 9: the difference between the embodiment and the embodiment 8 is as follows: the lock plate 56 can be also configured to be free of the extension section, and the lock plate 56 is fixedly connected with the fourth pin shaft 16 directly and moves along with the fourth pin shaft 16 simultaneously under the action of the tilting plate 3. The fixed connection between the lock plate 56 and the fourth pin shaft 16 can be 16 can be realized by the welding process or the integrated process.

What is claimed is:

1. A chassis of a swivel chair comprising:

a base (1) connected with an air rod, a bracket (2) used for fixing a seat and a tilting plate (3) connected with the backrest (2); wherein the bracket (2) is arranged within the base (1), the tilting plate (3) is arranged within the bracket (2);

a middle of the tilting plate (3) is provided with a first pin shaft (11) as a rotating shaft thereof, the first pin shaft (11) penetrates through the bracket (2) and is connected with the base (1);

two first connecting rods (13) and two second connecting rods (14) are symmetrically arranged at two sides of a front part of the tilting plate (3) respectively, one end of the first connecting rod is hinged with a front end of the tilting plate through a fourth pin shaft (16), the other end of the first connecting rod (13) is hinged with one end of the second rod (14) through a third pin shaft (15), the third pin shaft (15) is connected with the bracket (2), the other end of the second connecting rod (14) is provided with a second pin shaft (12), the second pin shaft (12) is connected with the base (1) after penetrating though the bracket (2);

two track grooves (17) which are matched with the first pin shaft (11) and used for guiding the motion trail of the bracket (2) are symmetrically arranged at two sides of the bracket (2) respectively, the first pin shaft (11) is moveably arranged within the track grooves (17); and the chassis further comprises an elastic reset device which leads the bracket (2) to be reset after the bracket is tilted by the tilting plate to move.

2. The chassis of the swivel chair according to claim 1, wherein two hollow grooves (18) are symmetrically arranged at two sides of the bracket (2), the second pin shaft (12) penetrates the hollow grooves (18) freely and is movable therein.

3. The chassis of the swivel chair according to claim 2, wherein the second pin shaft (12) is an integrated long shaft, and two ends of the second pin shaft (12) are connected with the base (1) after respectively penetrating through the second connecting rod (14) and the hollow grooves (18); or the second pin shaft (12) is two independent short shafts, one end of each short shaft is connected with the base (1) after penetrating through the second connecting rod (14) and the hollow grooves (18).

4. The chassis of the swivel chair according to claim 2, wherein the track grooves (17) and the hollow grooves (18) are all arranged in a tilting position.

5. The chassis of the swivel chair according to claim 1, wherein parts of two sides of the bracket (2), which interferes with the second pin shaft (12), are cut, so that the second pin shaft (12) does not contact the bracket (2).

6. The chassis of the swivel chair according to claim 1, wherein the first pin shaft (11) is an integrated long shaft, and two ends of the first pin shaft are connected with the base (1) after respectively penetrating through the tilting plate (3) and the track groove (17).

7. The chassis of the swivel chair according to claim 1, wherein a connection between the first pin shaft (11) and the base (1) is made by two first pin holes (9) that are symmetrically arranged at two sides of the back end of the base (1) and the first pin shaft (11) that is inserted into the first pin holes (9); a connection between the second pin shaft (12) and the base (1) is made by two second pin holes (10) that are symmetrically arranged at two ends of the front end of the base (1) and the second pin shaft (12) that is inserted into the second pin holes (10); and a connection between the third pin shaft and the base is made by the third pin shaft (15) that is inserted into the bracket (2) and is used for driving the bracket to synchronously move.

8. The chassis of the swivel chair according to claim 1, wherein the base (1) comprises a base plate (4) connected with the air rod, two support plates (5) that are respectively arranged at the left side and the right side of the base plate (4) along a vertical direction, the support plates (5) being fixedly connected with the base plate (4), and the first pin shaft (11) and the second pin shaft (12) connected with the support plates (5) of the base (1); the bracket (2) comprises two basal plates (6) which are in parallel with each other and arranged along a vertical direction, the upper ends of the basal plates (6) are bent to form a supporting plate (7) used for being connected with a seat, a connecting plate (8) is fixedly connected between the two basal plates (6), and the tilting plate (3) is arranged between the two basal plates (6).

9. The chassis of the swivel chair according to claim 1, wherein the first connecting rod (13) is arranged in a tilting position toward the tilting plate (3), the second connecting rod (14) is arranged in a tilting position oriented away from the tilting plate (3), and when the bracket (2) moves, an inclined angle between the second connecting rod (14) and a plumb line is less than or equal to 90 degrees.

10. The chassis of the swivel chair according to claim 1, wherein the chassis is further provided with a backrest tilting plate locking mechanism, wherein the backrest tilting plate locking mechanism comprises a row of lock holes (21) symmetrically arranged on the two sides of the tilting plate (3) as well as two torsion springs (23), two plug pins (23) and two plug pin bases (24), which are symmetrically arranged at the two sides within the base (1), the plug pin bases (24) are fixedly arranged on the base (1), the plug pins (23) are inserted through the plug pin bases (24) to slide relative thereto and are matched with the lock holes, first spring arms (25) of the torsion springs (23) are connected with the plug pins (23), and second spring arms (26) of the torsion springs (23) are connected with a drive device used for driving the torsion springs (23) to rotate.

11. The chassis of the swivel chair according to claim 10, wherein the drive device comprises a crank (27), a positioning base (28) and a stirring rod (29), wherein the positioning base (28) is fixedly connected with the base (1), the positioning base (28) is arc-shaped and is hollow in an inner part, an upper end of the positioning base (28) is provided with an arc lug boss (30) which extends downwards, the lug boss (30) is configured to divide the upper end in the positioning base (28) into two positioning grooves (31), the positioning base (28) is internally provided with a fixture block (35), an upper end of the fixture block (35) is clamped within the positioning grooves (31), two ends of the crank (27) are connected with the second spring arms of the two torsion springs (23), the crank (27) is connected with the fixture block (35) through a rocker (32), one end of the stirring rod (29) is fixedly connected with the fixture block (35) after penetrating through the base (1), and the other end of the stirring rod (29) extends outside of the base (1); the stirring rod (29) is movable forward and backward so that the fixture block (35) moves from one positioning groove into the other positioning groove, and the fixture block (35) rotates to drive the crank (27) such that the two torsion springs (23) are driven to rotate and under the action of the elasticity of the rotated torsion springs (23), the first spring arms drive the plug pins (23) into the corresponding lock holes (21) or out of the lock holes (21) to realize the lock and the unlock of the plug pins (23) respectively.

12. The chassis of the swivel chair according to claim 11, wherein the drive device further comprises two stand columns (33) for installing the torsion springs (23), the upper end of each stand column (33) is provided with a screw, the torsion springs (23) are arranged onto the screws, the lower end of each stand column (33) is fixedly connected with the base (1) through an arc bridge, a shaft hole (40) is formed between each arc bridge and the bottom surface of the base (1), and the stirring rod (29) penetrates through one of the arc bridges to be connected with the fixture block (35).

13. The chassis of the swivel chair according to claim 1, wherein the bracket (2) is connected with the elastic reset device, the elastic reset device is a spring (19), one end of the spring (19) is connected with the bracket (2), and the other end of the spring is connected with the base (1).

14. The chassis of the swivel chair according to claim 1, wherein the fourth pin shaft (16) is an integrated long shaft, and two ends of the fourth pin shaft (16) are respectively connected with one end of the first connecting rod (13) and the front end of the tilting plate (3).

15. The chassis of the swivel chair according to claim 14, wherein the chassis is further provided with a backrest tilting plate locking mechanism, wherein the backrest tilting plate locking mechanism comprises a lock plate (56), a torsion spring (22), a plug pin (23) and a plug pin base (24), a row of lock holes (21) are arranged on the lock plate (56), the lock plate (56) is fixedly connected with the fourth pin shaft (16) and moves synchronously with the fourth pin shaft (16) under the action of the tilting plate (3), the plug pin base (24) is arranged beside the lock plate (56) and is fixedly connected with the base (1), the plug pin (23) is inserted through the plug pin base (24) to slide relative thereto and is matched with the lock holes (21), a first spring arm (25) of the torsion spring (22) is connected with the plug pin (23), and a second spring arm (26) of the torsion spring (22) is connected with a drive device used for driving the torsion spring (22) to rotate.

16. The chassis of the swivel chair according to claim 15, wherein the drive device comprises a support base (59), a stirring rod (29) and a positioning ring (60) which is deformable, wherein the support base (59) is fixedly arranged on the plug pin base (24), the positioning ring (60) is fixedly arranged on the support base (59), the torsion spring (22) is mounted on a screw (39), the screw (39) is fixedly arranged on the support base (59), the positioning ring (60) is internally provided with a kidney-shaped hole (61), an arc lug boss is arranged in the middle of the kidney-shaped hole (61), the poisoning ring (60) is internally divided into two clamp grooves (62) due to the configuration of the lug boss (30), one end of the stirring rod (29) extends into the positioning ring (60) after penetrating through the base (1), and the other end of the stirring rod (29) extends outside of the base (1); a second spring arm (26) of the torsion spring (22) is connected with the end of the stirring rod (29), which extends into the positioning ring (60), and the stirring rod (29) is movable, so that the one end of the stirring rod moves into one of the clamp grooves (62), and the torsion spring (22) is driven to rotate; and under the elasticity action of the torsion spring (22) the first spring arm (25) moves the plug pin (23) to be inserted into the corresponding lock holes (21) or withdrawn out of the lock holes (21), so that the plug pin (23) can be locked and unlocked respectively.

17. The chassis of the swivel chair according to claim 15, wherein the plane where the lock plate (56) is arranged is perpendicular to the axis of the fourth pin shaft (16), and an upper end face (63*a*) and a lower end face (63*b*) of the lock plate are concaved to form grooves (64) which are matched with the plug pin (23), such that when the plug pin (23) is clamped within one of the grooves (64) of the upper end face (63*a*) and the lower end face (64*a*), the tilting plate can be locked at an initial angle and a maximum angle respectively.

18. The chassis of the swivel chair according to claim 15, wherein a plastic sleeve (55) is mounted onto the fourth pin shaft (16), the plastic sleeve (55) has a gap (58), and an extension section (57) of the lock plate (56) is properly clamped within the gap (58).

19. The chassis of the swivel chair according to claim 1, wherein the fourth pin shaft (16) is connected with the elastic reset device, the elastic reset device is a spring (19), one end of the spring (19) is connected with the fourth pin shaft (16), and the other end of the spring (19) hooks the base (1).

* * * * *